US005389504A

United States Patent [19]

Ling et al.

[11] Patent Number: 5,389,504

[45] Date of Patent: Feb. 14, 1995

[54] COLOR PHOTOGRAPHIC ELEMENTS CONTAINING A COMBINATION OF PYRAZOLONE AND PYRAZOLOAZOLE COUPLERS

[75] Inventors: Hans G. Ling, Rochester; Drake M. Michno, Webster; Stephen Singer, Spencerport, all of N.Y.

[73] Assignee: Eastman Kodak Company, Rochester, N.Y.

[21] Appl. No.: 82,076

[22] Filed: Jun. 24, 1993

[51] Int. Cl.[6] ..... G03C 1/46

[52] U.S. Cl. ..... 430/506; 430/503; 430/549; 430/555; 430/558

[58] Field of Search ..... 430/549, 506, 503, 555, 430/558

[56] References Cited

U.S. PATENT DOCUMENTS

| | | | |
|---|---|---|---|
| 4,438,194 | 3/1984 | Hamada | 430/506 |
| 4,571,378 | 2/1986 | Sauerteig et al. | 430/506 |
| 4,600,688 | 7/1986 | Kawakatsu et al. | 430/558 |
| 4,681,837 | 7/1987 | Mitsui et al. | 430/504 |
| 4,853,319 | 8/1989 | Krishnamurthy et al. | 430/387 |
| 5,262,288 | 11/1993 | Sakanoue et al. | 430/558 |

FOREIGN PATENT DOCUMENTS

| | | |
|---|---|---|
| 0230048 | 7/1987 | European Pat. Off. . |
| 0467327 | 1/1992 | European Pat. Off. . |
| 3536244 | 4/1986 | Germany . |
| 61-80251 | 4/1986 | Japan . |
| 62-18558 | 1/1987 | Japan . |
| 62-206544 | 9/1987 | Japan . |
| 63-52138 | 3/1988 | Japan . |
| 63-52139 | 3/1988 | Japan . |

OTHER PUBLICATIONS

Masao et al., "Formation of Color Photographic Image", JP 61-273544, (1985), Abstract.

Derwent Publication Abstract, JP 62-194254, (1987).

*Primary Examiner*—Charles L. Bowers, Jr.

*Assistant Examiner*—Geraldine Letscher

*Attorney, Agent, or Firm*—Arthur E. Kluegel

[57] ABSTRACT

A photographic element including a support and first and second green-sensitive silver halide emulsion layers of different sensitivity, wherein the layer of higher sensitivity includes a two-equivalent magenta dye-forming coupler selected from the group consisting of a pyrazolone coupler having a structure according to formula I and a pyrazoloazole coupler having a structure according to formula II as set forth in the disclosure, and the layer of lower sensitivity includes a two-equivalent magenta dye-forming coupler selected from the group consisting of couplers defined by formulas I and II. The activity of the magenta dye-forming coupler present in the layer of lower sensitivity is less than the activity of the coupler present in the layer of higher sensitivity. The layers of higher and lower sensitivity do not comprise magenta couplers which are defined by the same formula.

34 Claims, No Drawings

COLOR PHOTOGRAPHIC ELEMENTS CONTAINING A COMBINATION OF PYRAZOLONE AND PYRAZOLOAZOLE COUPLERS

BACKGROUND OF THE INVENTION

1. Field of the Invention

This invention relates to silver halide photographic materials having improved granularity and color saturation. In particular, the invention relates to a photographic element containing at least two separate layers of different sensitivity to green light, including a more active magenta coupler in the more sensitive layer and a less active magenta coupler in the less sensitive layer or layers, wherein one of said magenta couplers is a pyrazolone coupler and the other of said magenta couplers is a pyrazoloazole coupler.

2. Description of Related Art

There is a continuing need in the photographic art to improve and optimize the attributes of the film, such as the image structure of the film. In particular, there is a desire to reduce the amount of "noise," or nonuniformity, in the developed film. The visual sensation produced by such nonuniformity is termed "graininess," while the objective measure of the nonuniformity is termed "granularity." See T. H. James, "The Theory of the Photographic Process," (4th ed. 1977), pp. 618–33). Preferably, reduction in the granularity of the developed film should be achieved without adversely affecting other photographic parameters, such as sensitivity to light (speed), latitude, sharpness, interimage effects, curve shape, D-max, and density.

Various approaches to optimizing granularity are known in the art. Such approaches include: coating high concentrations of silver; reducing the size of grains in the film; and decreasing the full development of grains by the use of development inhibitors. The foregoing methods are not always desirable, however, since they require the coating of additional silver in order to obtain the desired curve shape and density. The use of more silver is additionally disadvantageous since it often results in increased light scattering, which degrades the performance of the underlying layers. Moreover, use of excess silver can result in difficulties in the removal (bleaching) of the silver from the developed film.

Smearing couplers have also been used to reduce granularity. This method, however, often undesirably reduces the film sharpness.

Another approach, use of couplers that generate low extinction dyes, involves the use of more silver, with the accompanying disadvantages discussed above.

Another method, involving coating reduced amounts of couplers in the layers of the photographic element in order to "starve" the coupler, generally has a negative impact on D-max, curve shape, color saturation, and silver efficiency.

Pyrazolone and pyrazoloazole compounds are well known in the art to react with oxidized developer in a photographic system to produce magenta dyes. Both of these classes of compounds are useful as two-equivalent image couplers, that is, couplers having a coupling-off group that is photographically inert and does not serve any additional function such as inhibition, bleach acceleration, color masking and the like.

Photographic elements using only pyrazoloazole compounds as the image coupler can have excellent image structure, particularly granularity, but are deficient in terms of process sensitivity. In particular, small changes in the composition of the processing solutions can result in excessive fluctuations in photographic responses such as contrast. In practice, this leads to unpredictable shifts in overall color balance.

Conversely, photographic elements using only pyrazolone compounds as the image coupler can have excellent process sensitivity, but are deficient in terms of image structure, particularly granularity. This is because pyrazolone couplers do not allow for good coupler "starvation," especially when located in the most light-sensitive layers, a methodology known to reduce overall granularity.

It is known to use combinations of various pyrazolone and pyrazoloazole couplers in the same or different layers of a photographic element, as shown, for example, in U.S. Pat. No. 4,600,668, European patent application EP-A-0 467 327 A1, and Japanese publications 61-273,544 and 62-206544. However, these and other known elements have not proven to be satisfactory, and the known methods of reducing granularity typically have an adverse effect on other film properties.

Accordingly, there is a need for a film that has reduced granularity and the desired high color saturation without adverse impact on other desired photographic parameters such as latitude, sharpness, interimage effects, and total materials laydown for silver, couplers, and other components.

SUMMARY OF THE INVENTION

These and other needs have been satisfied by providing, in accordance with one aspect of the invention, a photographic element comprising a support and at least two green-sensitive silver halide emulsion layers of different sensitivity. The layer of higher sensitivity contains a two-equivalent magenta dye-forming coupler selected from the group consisting of a pyrazolone coupler having a structure according to formula I:

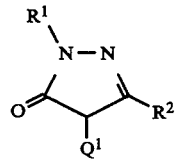

(I)

wherein $R^1$ is an unsubstituted aryl group, or an aryl or pyridyl group substituted with one or more substituents selected from the group consisting of halogen atoms and alkyl, alkoxy, aryloxy, acyloxy, alkoxycarbonyl, aryloxycarbonyl, alkylsulfonyl, arylsulfonyl, sulfamoyl, sulfonamido, carbamoyl, carbonamido, ureido, nitro, cyano and trifluoromethyl;

$R^2$ is an anilino, acylamino or ureido group which is unsubstituted or substituted with one or more substituents selected from the group consisting of halogen atoms and alkyl, aryl, alkoxy, aryloxy, acyl, acyloxy, alkoxycarbonyl, aryloxycarbonyl, alkylthio, alkylsulfoxyl, arylsulfoxyl, alkylsulfonyl, arylsulfonyl, sulfamoyl, sulfonamido, carbamoyl, carbonamido, carbamate, carboxyl, ureido, nitro, imido, cyano, trifluoromethyl, hydroxyl and heterocyclyl groups and groups which form a link to a polymeric chain, and wherein $R^2$ contains at least 6 carbon atoms, and $Q^1$ is a coupling-off group selected from the group consisting of halogen atoms and alkoxy, aryloxy, alkylthio, arylthio, acyloxy, sulfonamido, sulfonyloxy, carbonamido, arylazo, imido and nitrogen-containing heterocyclic groups, and a pyrazoloazole coupler having a structure according to formula II:

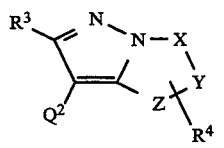

(II)

wherein $R^3$ is a substituent in the 6-position which does not adversely affect the desired properties of the coupler, $Q^2$ is a coupling-off group, X, Y, Z are individually carbon or nitrogen atoms necessary to complete an azole ring, with unsaturated bonding being present in the ring as needed, $R^4$ denotes the group

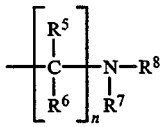

$R^5$, $R^6$ are individually hydrogen or unsubstituted or substituted alkyl or aryl, at most one of $R^5$ and $R^6$ being hydrogen, n is 1 or 2, $R^7$, $R^8$ are individually hydrogen, unsubstituted or substituted alkyl or aryl, —C(O)—$R^9$ or —$SO_2R^9$, at most one of $R^7$ and $R^8$ being hydrogen, $R^9$ is unsubstituted or substituted alkyl or aryl or —NH—$R^{10}$, and $R^{10}$ is unsubstituted or substituted alkyl or aryl, and the layer of lower sensitivity contains a two-equivalent magenta dye-forming coupler selected from the group consisting of couplers defined by formulas I and II above, with the proviso that said layers of higher and lower sensitivity do not contain magenta couplers which are defined by the same formula. That is, if the layer of higher sensitivity contains a pyrazolone coupler as defined by formula I, then the layer of lower sensitivity contains a pyrazoloazole coupler as defined by formula II. Conversely, if the layer of higher sensitivity contains a pyrazoloazole coupler as defined by formula II, then the layer of lower sensitivity contains a pyrazolone coupler as defined by formula I.

Preferably, the pyrazoloazole coupler according to formula II is a pyrazolotriazole coupler.

The activity of the magenta coupler present in the layer of lower sensitivity is less than the activity of the magenta coupler present in the layer of higher sensitivity. Preferably, the activity of the former magenta coupler is less than about 85% of the activity of the latter magenta coupler.

The photographic element can optionally include at least one additional silver halide layer sensitive to green light, of a sensitivity intermediate between the higher and lower sensitivity layers. The intermediate and lower sensitivity layers include the same magenta coupler.

It is not necessary that these layers of different sensitivities to green light (lower, immediate, higher), be contiguous, but they may be separated in space by other layers such as non-imaging interlayers or layers sensitive to other wavelengths of light, such as blue or red light.

There are also provided multi-color photographic elements including a magenta dye image-forming unit as described above, and processes for developing images in photographic elements including such image-forming units.

DETAILED DESCRIPTION OF THE PREFERRED EMBODIMENTS

It has now been discovered that incorporation according to the invention of a higher-activity two-equivalent magenta coupler in a more sensitive layer of a magenta image-forming unit, and a lower-activity magenta coupler in a less sensitive layer of the same magenta image-forming unit, results in a marked improvement in both graininess (having low granularity) and color saturation (having high color saturation), without adversely affecting other film characteristics. The inventive combination achieves good magenta dye hue, and also has a lower sensitivity to film developer processing pH as compared to photographic elements including only pyrazoloazole dye-forming couplers.

The term "activity" as used herein denotes the rate at which a coupler reacts with oxidized developer. A coupler of higher activity will react with oxidized developer to form dye more rapidly than a coupler of lower activity. When the coupler of higher activity is much more active than the coupler of lower activity (for example, one thousand times as active), the more active coupler will react with the oxidized developer until the coupler is substantially depleted. Substantially none of the less active coupler will react until depletion of the more active coupler. In contrast, when the coupler of higher activity is only somewhat more active than the coupler of lower activity (for example, twice as active), the more active coupler will react somewhat in preference to the less active coupler, but both will react to some extent depending on the amount of development. Thus, at low exposures (with low amounts of oxidized developer generated), reaction of the more active coupler will dominate, with the less active coupler reacting to a slight extent. At mid-level exposures, both couplers will react, with the more active coupler reacting to a slightly greater extent than the less active coupler. At high exposures, the more active coupler will be fully consumed, allowing the less active coupler to react to an overall greater extent.

According to the invention, the activity of the coupler in the less sensitive layer preferably is less than about 85% of the activity of the coupler in the more sensitive layer.

The higher activity magenta coupler is coated in the faster silver halide emulsion in such a way that some coupler starvation (as described, for example, in U.S. Pat. Nos. 3,843,369 and 4,145,219 and U.K. Patent No. 923,045) will occur in this fast layer. The coupler is matched with the emulsion in a way such that the optimum photographic speed, latitude and density is obtained in this layer. This means that the coupler typically reacts with oxidized developer as soon as it is generated until the coupler is depleted. The activity of this coupler is high enough to allow the coupling reaction to compete with other image-modifying chemistries in the layer, such as the action of DIR compounds, so as to optimize the desired speed. It is preferred that the ratio of coupler to silver halide emulsion, on the basis of coated weight, be less than about 0.20.

Both the higher activity coupler and the lower activity coupler are coated in the respective emulsions in such a way as to optimize the overall granularity of the magenta record. The slower emulsion and coupler are chosen to give the optimum latitude and curve shape for effective imaging together with the fast layer. These optimizations are carried out in a manner known to those skilled in the art.

The activity of couplers can be measured by comparing the relative rates of activity. A test has been established which uses citrazinic acid (CZA) (2,6-dihydroxyisonicotinic acid) to compete with the coupler. High activity couplers will generate more dye than low activity couplers in competition with CZA. The method of determining relative coupler activities is described in Example 1 below.

The pyrazolone couplers employed according to the invention are substantially non-diffusible when incorporated in the inventive photographic element. Couplers are typically made non-diffusible by incorporation of a ballast group, that is, a group that renders the entire coupler hydrophobic, or by attachment to a polymeric backbone.

In a preferred embodiment, $R^1$ in formula I is a group having the structure

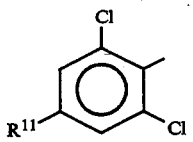

wherein $R^{11}$ is a halogen atom or an alkoxy, aryloxy, acyloxy, alkoxycarbonyl, aryloxycarbonyl, alkylsulfonyl, arylsulfonyl, sulfamoyl, sulfonamido, carbamoyl, carbonamido, ureido, nitro, cyano or trifluoromethyl group.

The total number of carbon atoms contained in $R^2$ is at least 6, and preferably is between 6 and 30. In a preferred embodiment, $R^2$ in formula II is a group having the structure

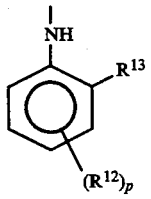

wherein p is 0, 1 or 2, and each $R^{12}$ is meta or para to $R^{13}$, $R^{12}$ are individually a halogen atom or an alkyl, alkoxy, aryloxy, acyl, acyloxy, aryloxycarbonyl, alkylthio, alkylsulfoxyl, arylsulfoxyl, sulfonamido, sulfamoyl, carbonamido, carbamoyl, carbamate, carboxyl, ureido, nitro, imido, cyano, trifluoromethyl or heterocyclyl group, and $R^{13}$ is hydrogen, a halogen atom, and an alkyl, alkoxy, aryloxy, acyl, acyloxy, alkoxycarbonyl, alkylthio, alkylsulfonyl, sulfonamido, sulfamoyl, carbonamido, carbamoyl, nitro, cyano or trifluoromethyl group.

Preferably, $R^{13}$ is a chlorine atom or an alkoxy group.

Coupling-off groups, defined by $Q^1$ and $Q^2$ herein, are well known to those skilled in the art. Representative classes of coupling-off groups include halogen, particularly chlorine, bromine and fluorine, alkoxy, carbonamido, imido, aryloxy including in particular substituted phenoxy, heterocycloxy, sulfonyloxy, acyloxy, heterocyclyl, thiocyano, alkylthio, arylthio, particularly substituted phenylthio, heterocyclylthio, sulfonamido, phosphonyloxy and arylazo. These are described, for example, in U.S. Pat. Nos. 2,355,169, 3,227,551, 3,432,521, 3,476,563, 3,617,291, 3,880,661, 4,052,212, and 4,134,766; and in U.K. Patent and published Application Nos. 1,466,728, 1,531,927, 1,533,039, 2,006,755A, and 2,017,704A.

It is preferred that the coupling-off group $Q^1$ has the structure

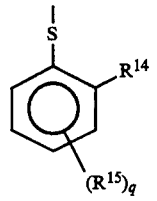

wherein $R^{14}$, $R^{15}$ are individually hydrogen, halogen or an alkyl, alkoxy, aryloxy, acyloxy, alkoxycarbonyl, aryloxycarbonyl, sulfonamido, sulfamoyl, carbonamido, carbamoyl, carbamate, carboxyl, ureido or amino group, and q is 0, 1 or 2.

$R^{15}$ is meta or para to the sulfur atom.

The groups $R^{14}$ and $R^{15}$ may optionally be further substituted. It is particularly preferred that $R^{14}$ has at least one carbon atom and that the total number of carbon atoms in $R^{14}$ and $R^{15}$ is between about 5 and 25.

Preferred pyrazolone couplers are those having the following structure:

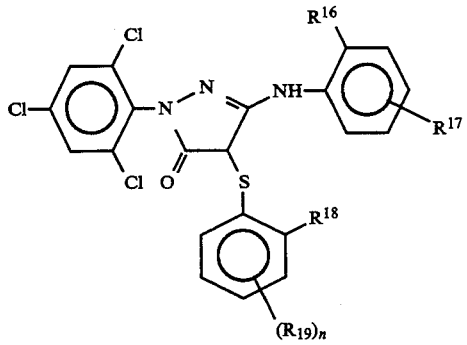

wherein $R^6$ is halogen, in particular Cl or alkoxy, particularly methoxy, $R^{17}$ is a ballast group meta or para to the nitrogen atom in the anilino group, particularly —NHCO—$R^{19}$, —$SO_2$NH—$R^{19}$, —CONH—$R^{19}$, or $SO_2R^{19}$, $R^{18}$ is —NHCO—$R^{20}$ or —O—$R^{20}$, $R^{19}$ is an alkyl group, $R^{20}$ is unsubstituted or substituted alkyl, and n is 0 or 1.
Methylene bis-pyrazolones are excluded from the scope of the instant invention.
Exemplary pyrazolone couplers useful in practicing the instant invention include without limitation the following:
P-1
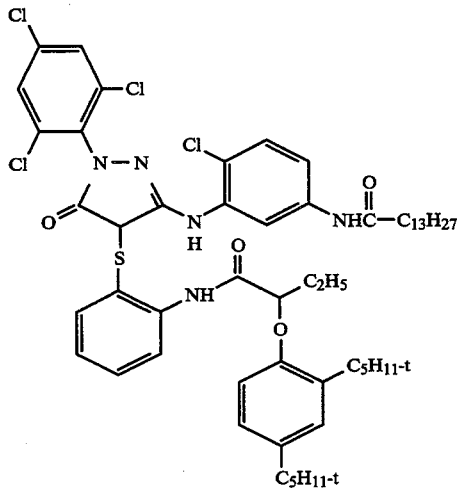
P-2
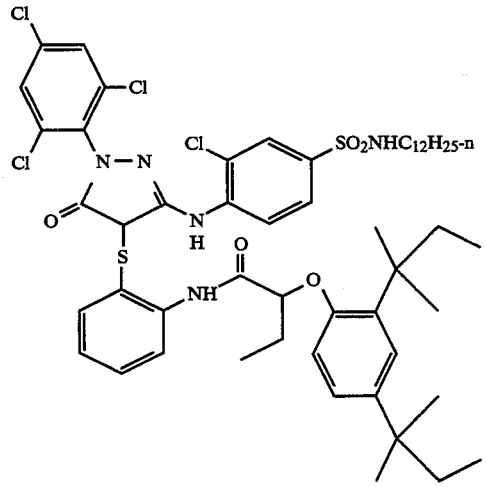
P-3
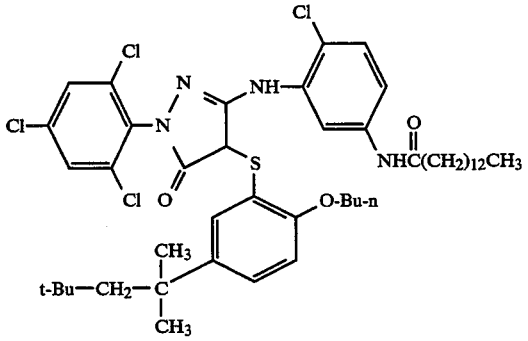
P-4
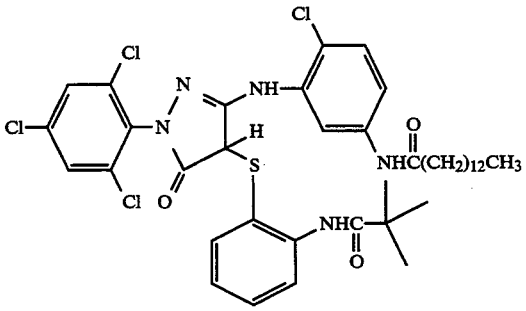
P-5
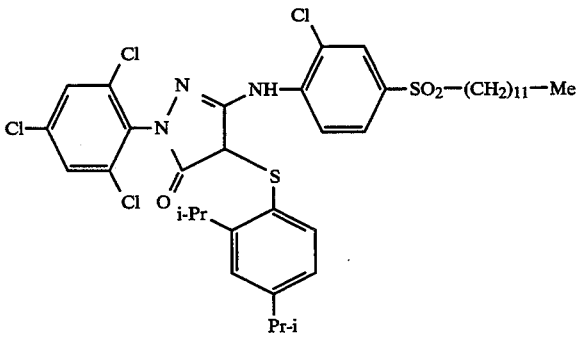
P-6
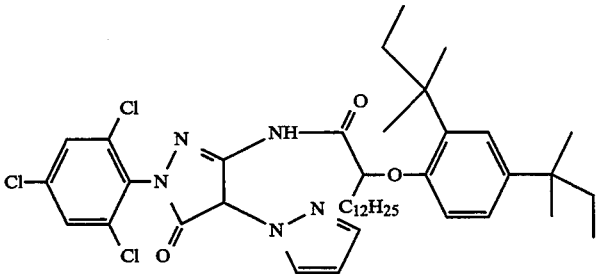

-continued
P-7
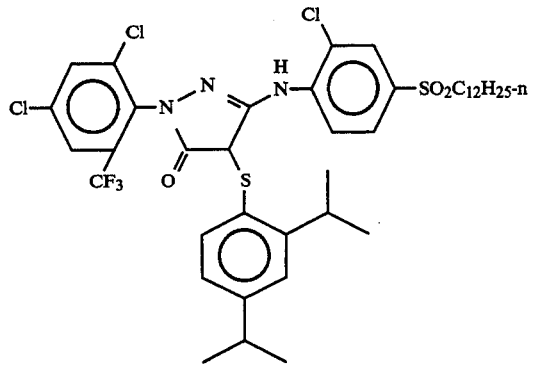
P-8
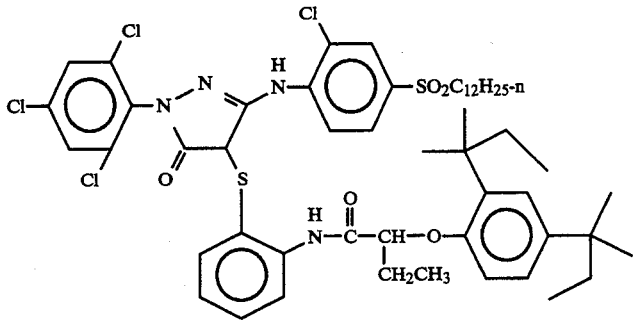
P-9
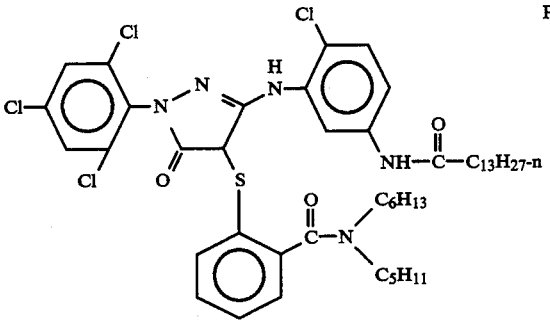
P-10
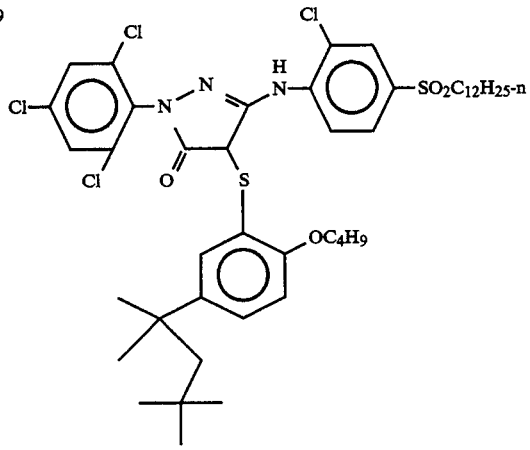
P-11
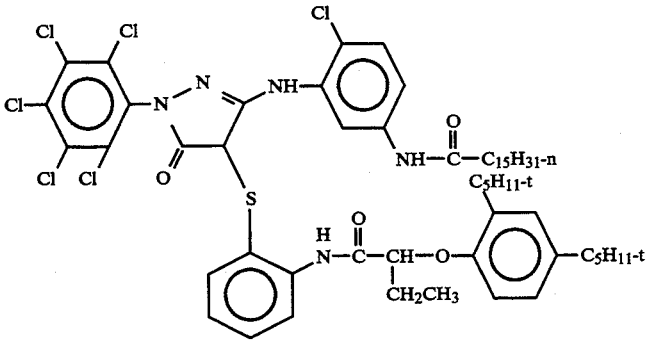

-continued
P-12
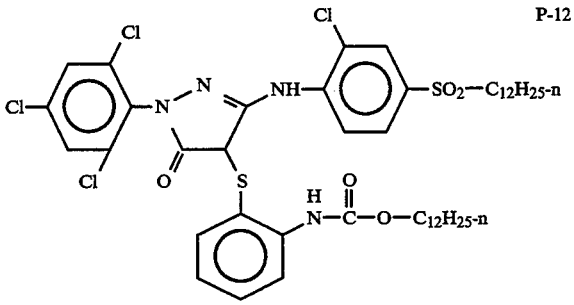
P-13
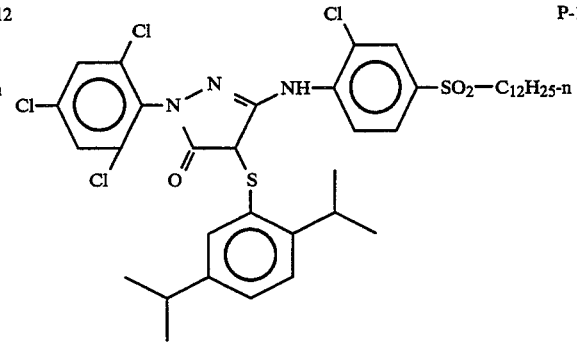
P-14
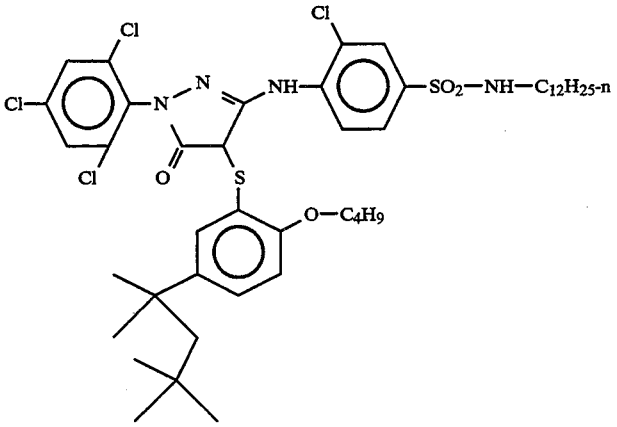
P-15
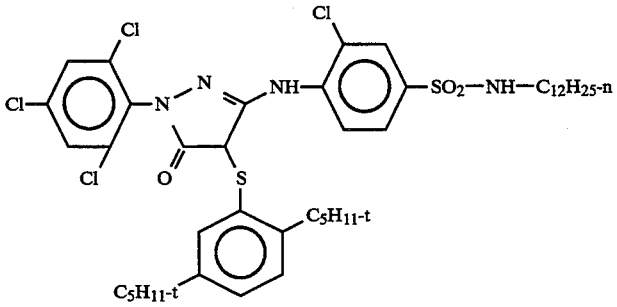
P-16
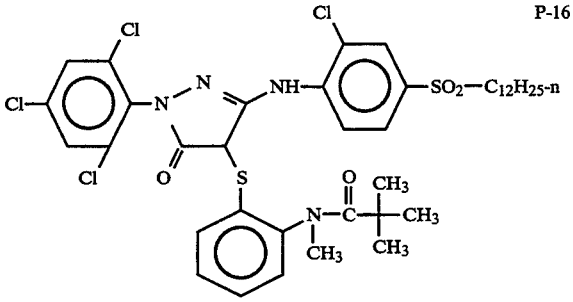
P-17
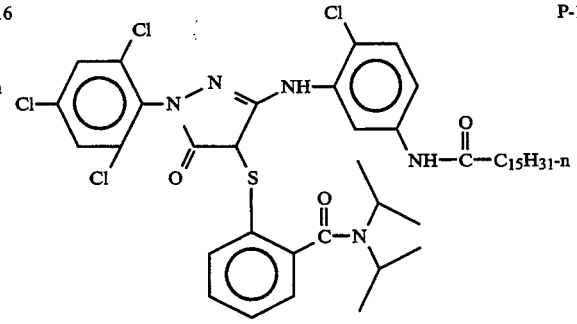

-continued
P-18
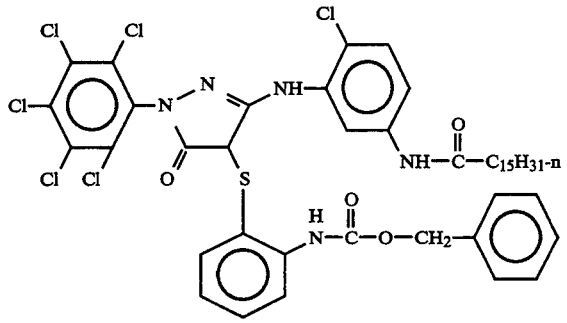
P-19
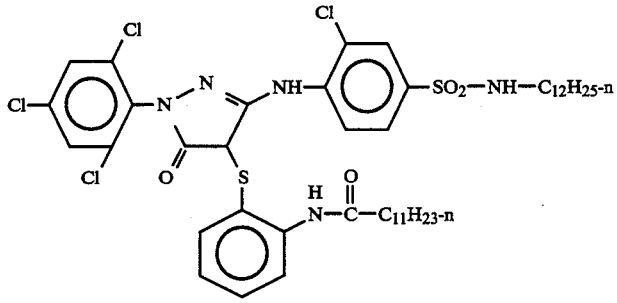
P-20
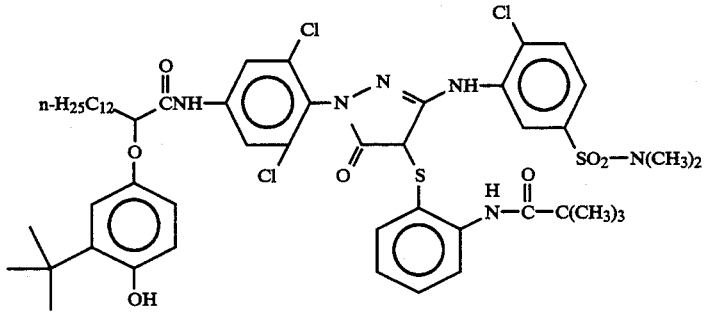
P-21
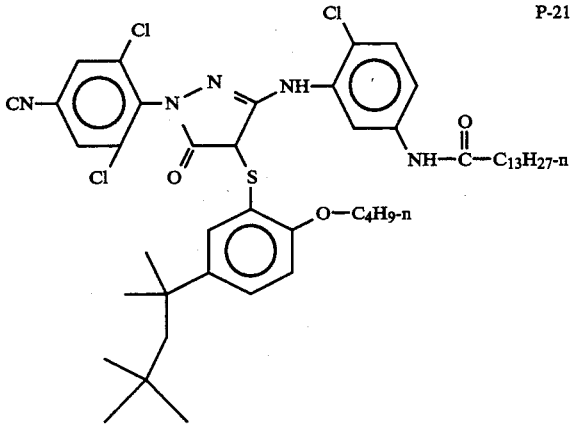
P-22
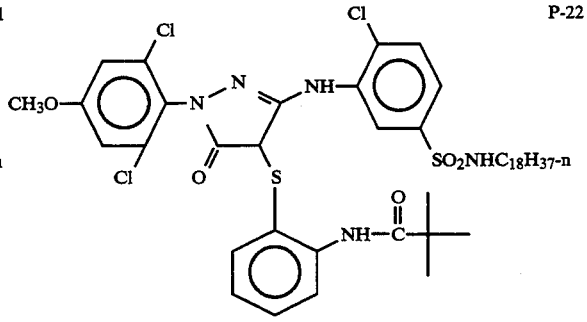

-continued
P-23
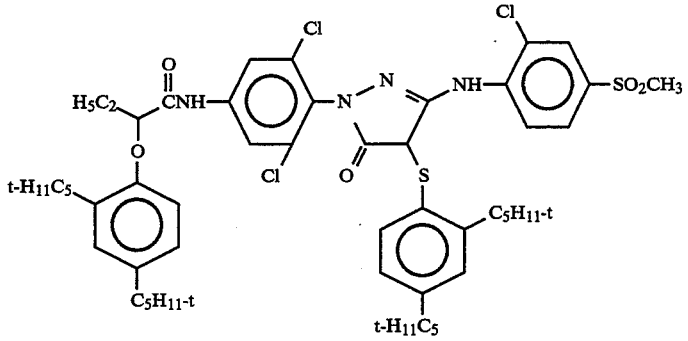
P-24
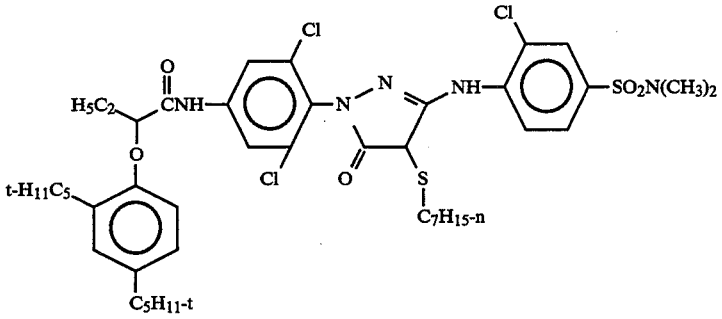
P-25
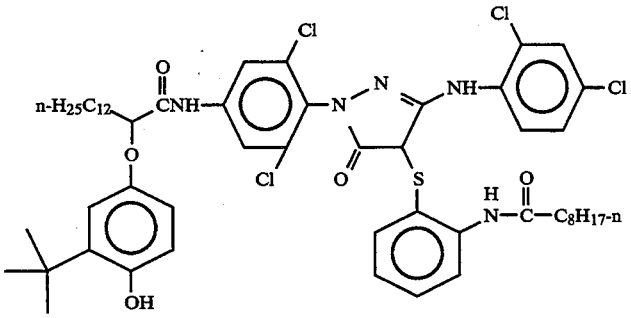
P-26
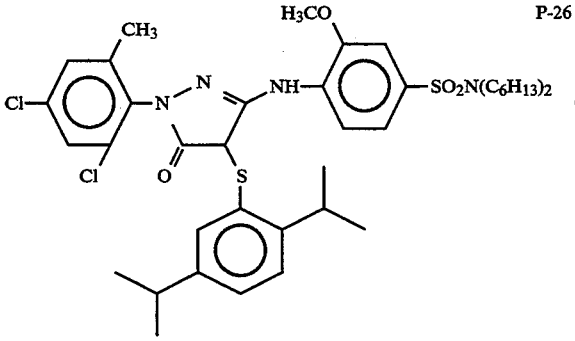
P-27
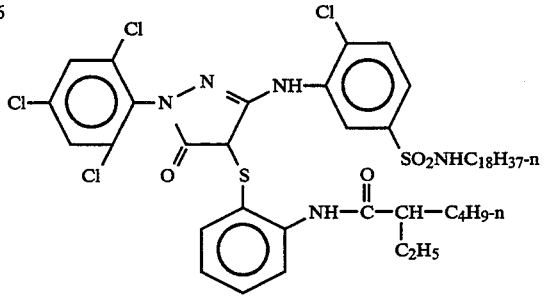
P-28
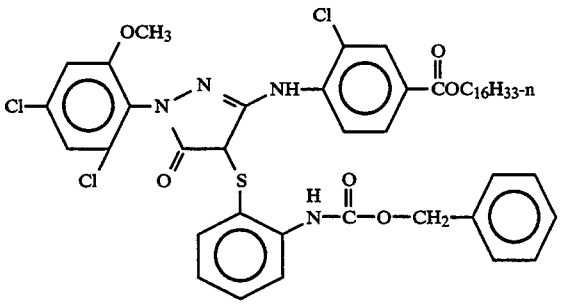

-continued
P-29
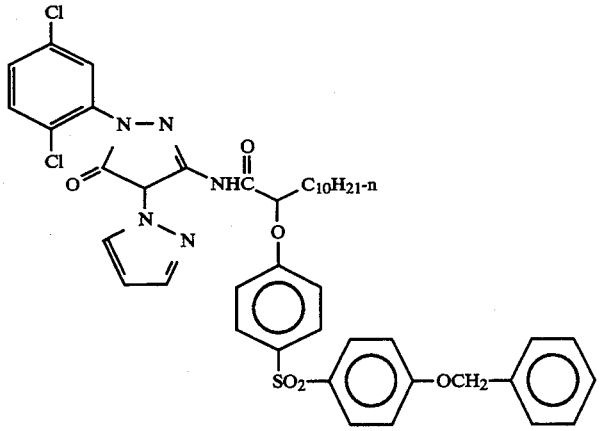
P-30
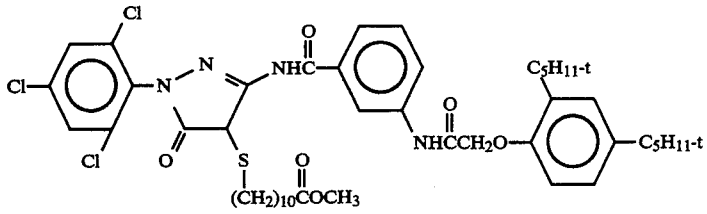
P-31
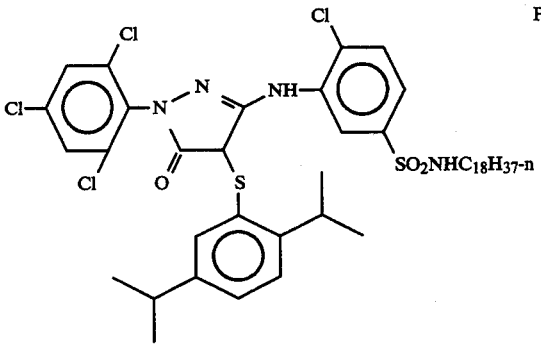
P-32
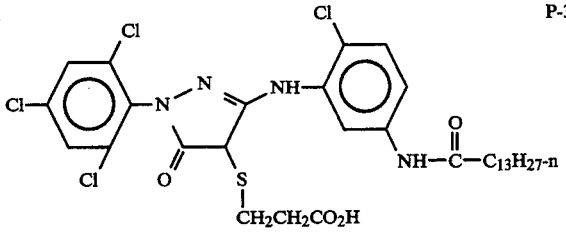
P-33
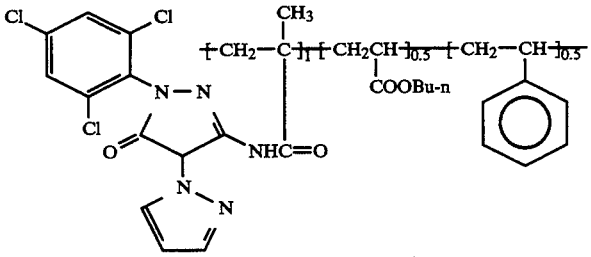
P-34
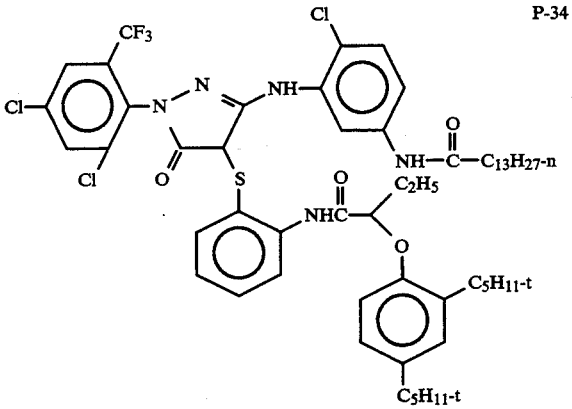
P-35
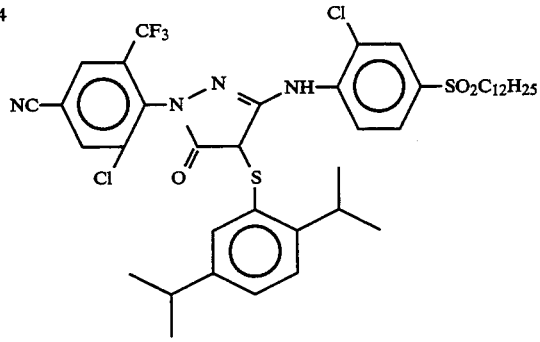

-continued
P-36
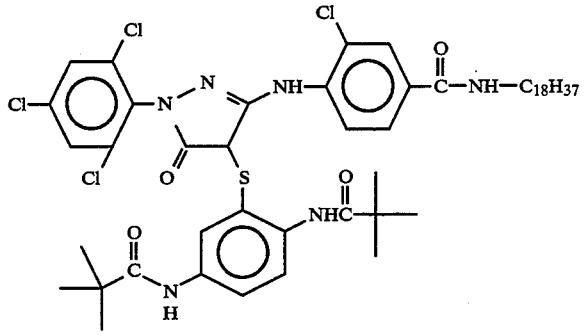
P-37
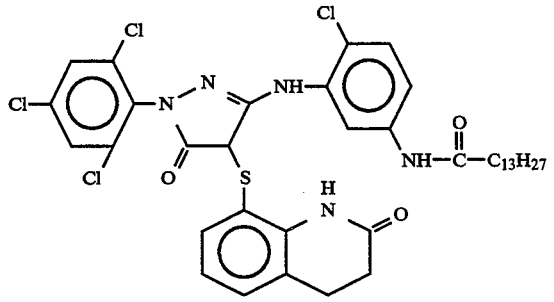
P-38
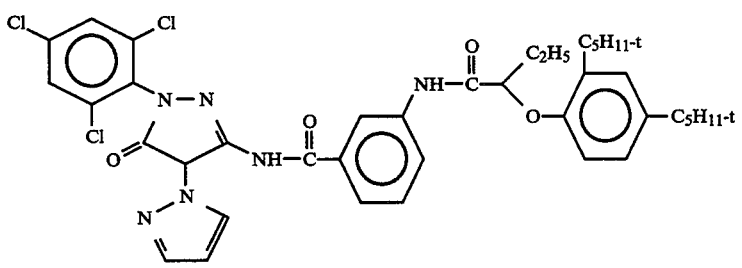
Other pyrazolone couplers which can be utilized according to the invention are described in U.S. Pat. No. 4,853,319.
The pyrazoloazole couplers according to formula II preferably are substituted at the 6-position by a group $R^3$ which is unsubstituted or substituted alkyl, aryl, alkoxy or carbonamido.
Preferred examples of the group $R^4$ include:
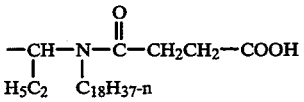
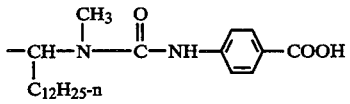
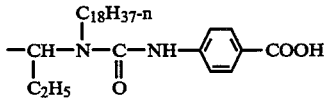
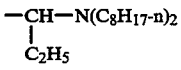
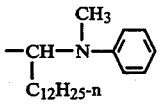
-continued
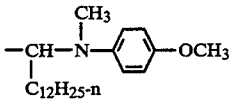
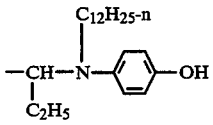
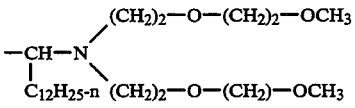
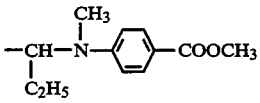
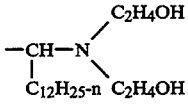

-continued
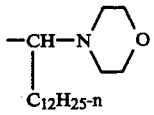
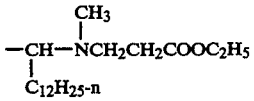
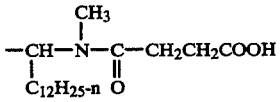
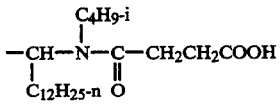
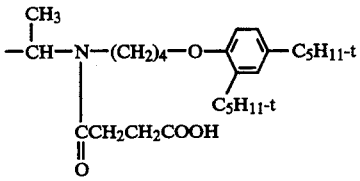
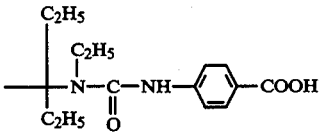
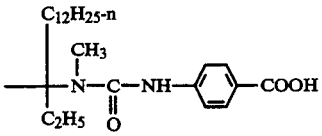
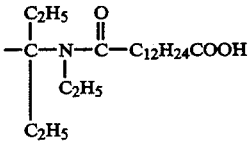
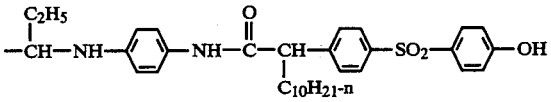
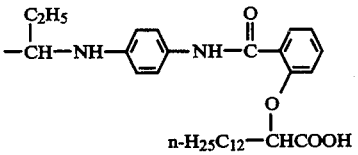
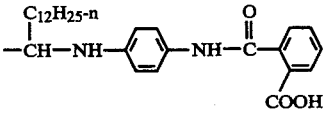
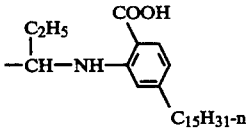
-continued
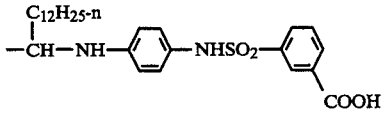
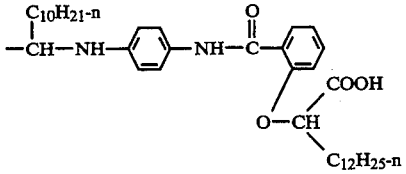
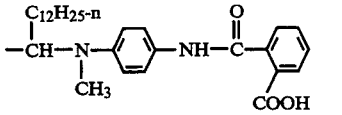
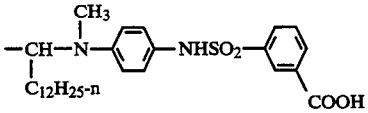
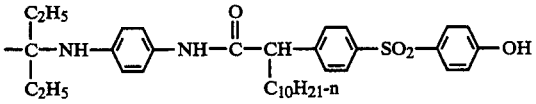
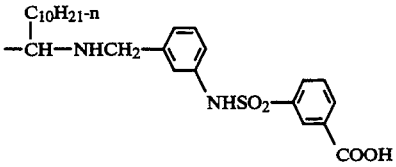
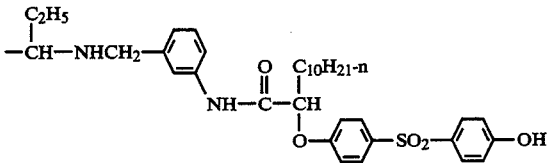
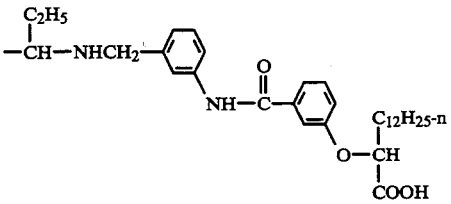
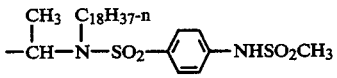
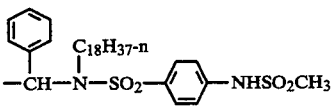
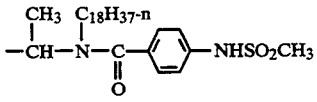

-continued

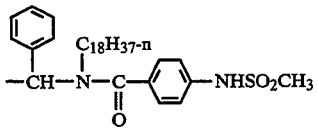

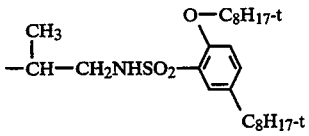

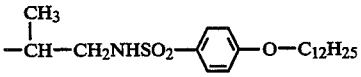

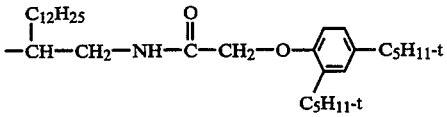

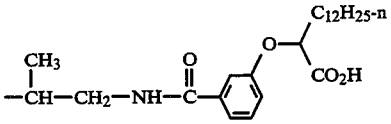

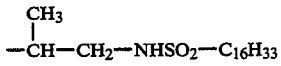

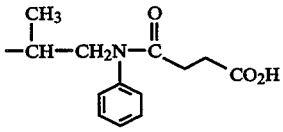

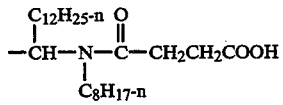

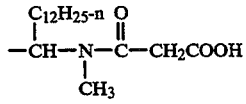

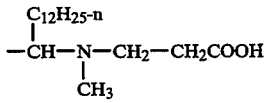

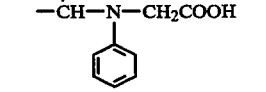

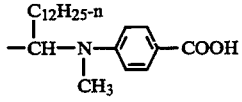

Preferred couplers within the scope of formula II are pyrazolotriazoles, in which X and Y or Y and Z are nitrogen atoms, with the necessary unsaturated bonding being present. Pyrazolotriazole couplers for use according to the instant invention preferably have structures according to formulas III and IV:

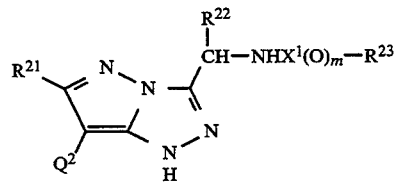

(III)

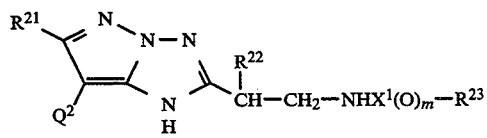

(IV)

wherein $R^{21}$ is a substituent which does not adversely affect the desired properties of the pyrazolotriazole coupler, $R^{22}$ is unsubstituted or substituted alkyl or aryl, $R^{23}$ is unsubstituted or substituted alkyl, aryl or —N—H—$R^{24}$, $R^{24}$ is unsubstituted or substituted alkyl or aryl, $X^1$is a carbon or sulfur, and m is 1 is $X^1$ is carbon and 1 or 2 if $X^1$ is sulfur.

Coupling-off group $Q^2$ is as defined in formula II above.

Preferably, $R^{21}$ is unsubstituted or substituted alkyl or aryl.

$R^{22}$ and $R^{23}$ are preferably independently unsubstituted straight or unsubstituted branched $C_1$–$C_{12}$ alkyl, such as methyl, octyl, t-butyl, decyl, and dodecyl, or unsubstituted phenyl.

It is preferred that at least one of $R^{22}$–$R^{24}$ contain water soluble groups such as carboxy, sulfonamido, —$SO_2NH$, carbonoyl, amido, hydroxy, sulfo, or ether.

The groups $R^3$ in formula II and $R^{21}$ in formulas III and IV (substituents at the 6-position of the pyrazoloazole ring) should aid solubility or diffusion resistance and produce a dye of desired hue upon reaction of the coupler with an oxidized color developing agent. These groups should not adversely affect the coupler. Exemplary substituent groups include alkyl (including $C_{1-30}$-alkyl, such as methyl, ethyl, propyl, n-butyl, t-butyl, octyl and eicosyl), aryl (including $C_{6-30}$-aryl, for example, phenyl, naphthyl and mesityl), cycloalkyl (such as cyclohexyl and cyclopentyl), alkoxy (including $C_{1-30}$-alkoxy, such as methoxy, i-butoxy and dodecyloxy), aryloxy (including $C_{6-30}$-aryloxy, for example, phenoxy and naphthoxy), alkoxycarbonyl (such as ethoxycarbonyl and dodecyloxycarbonyl), aryloxycarbonyl (such as phenoxycarbonyl), alkylthio (including $C_{1-30}$-alkylthio, such as methylthio and i-butylthio), arylthio (including $C_{6-30}$-arylthio such as phenylthio), alkanesulfonyl (such as ethanesulfonyl and butanesulfonyl), amino, acylamino (including $C_{2-30}$-acylamino, for example acetamido, benzamido and stearamido), ureido, carboxy, cyano, carbamyl (such as methyl carbamyl and hexyl carbamyl), sulfamyl (such as dioctyl sulfamyl and methyloctadecyl sulfamyl), sulfonamido, carboxamido, and heterocyclic groups, such as groups comprised of atoms selected from the group consisting of carbon, oxygen, nitrogen and sulfur atoms necessary to complete a 5- or 6-member heterocyclic ring, for example pyridyl, benzoxazolyl, furyl and thienyl.

Preferably, when X is carbon, m is 1, and when X is sulfur, m is 1 or 2, very preferably 2.

The foregoing groups on the pyrazoloazole coupler are unsubstituted or optionally substituted with groups that do not adversely affect the desired properties of the coupler. Examples of useful substituents include ballast groups and coupler moieties known to be useful in the photographic art, and alkyl groups, such as $C_{1-14}$-alkyl, for example, methyl, ethyl and t-butyl.

$R^3$ and $R^{21}$, defined above, preferably are tertiary carbon groups:

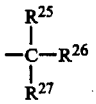

wherein $R^{25}$, $R^{26}$ and $R^{27}$ are individually substituents that do not adversely affect the coupler.

Preferred substituents $R^{25}$, $R^{26}$ and $R^{27}$ include halogen (such as chlorine, bromine and fluorine); alkyl, (including $C_{1-30}$-alkyl, such as methyl, ethyl, propyl, butyl, pentyl, ethylhexyl and eicosyl); aryl (for example $C_{6-30}$-aryl, such as phenyl, naphthyl and mesityl); carbonamido; ureido; carboxy; cyano; sulfamyl; sulfonamido; carboxamido; cycloalkyl (such as cyclohexyl and cyclopentyl); alkoxy (including $C_{1-30}$-alkoxy, such as methoxy, ethoxy, butoxy and dodecyloxy); aryloxy (including $C_{6-30}$-aryloxy, such as phenoxy and naphthoxy); alkylthio (such as $C_{1-30}$-alkylthio, including methylthio, ethylthio, propylthio, butylthio and dodecylthio); arylthio (including $C_{6-30}$-arylthio, such as phenylthio and naphthylthio); amino (including dioctylamino, dimethylamino and dodecylamino); acylamino (such as $C_{1-30}$-acylamino, including acetamido, benzamido and stearamido); and heterocyclyl (including 5- or 6-member heterocyclic rings such as pyrrolyl, oxazolyl and pyridyl).

Optionally, in such a tertiary group, $R^{25}$ can form with one of $R^{26}$ and $R^{27}$ a heterocyclic ring, such as a heterocyclic ring comprised of atoms selected from carbon, oxygen, nitrogen and sulfur atoms necessary to complete a 5- or 6-member heterocyclic ring, for example pyrrole, oxazole, pyridine and thiophene; or $R^{25}$ can form with one of $R^{26}$ and $R^{27}$ a carbocyclic ring, such as cyclohexyl or norbornyl; or $R^{25}$, $R^{26}$ and $R^{27}$ can comprise the carbon and hydrogen atoms necessary to complete a ring, such as an adamantyl ring.

The groups $R^{25}$, $R^{26}$ and $R^{27}$ are unsubstituted or optionally further substituted with groups that do not adversely affect the desired properties of the pyrazolotriazole coupler. The groups can be optionally substituted with groups such as $C_{1-20}$-alkyl, including methyl, ethyl, propyl and butyl; $C_{6-30}$-aryl, such as phenyl and naphthyl; or phenolic, carboxylic acid and heterocyclic substituent groups. Substituents can include ballast groups and coupler moieties known to be useful in the photographic art.

A ballast group, as is known to the art, is an organic radical of such size and configuration as to confer on the coupler molecule sufficient bulk to render the coupler substantially non-diffusible from the layer in which it is coated in a photographic element. Couplers of the invention can contain ballast groups, or be bonded to polymeric chains through one or more of the groups described herein. For example, one or more coupler moieties can be attached to the same ballast group. Representative ballast groups include substituted or unsubstituted alkyl or aryl groups containing 8 to 32 carbon atoms. Representative substituents include alkyl, aryl, alkoxy, aryloxy, alkylthio, arylthio, hydroxy, halogen, alkoxycarbonyl, aryloxycarbonyl, carboxy, acyl, acyloxy, carbonamido, carbamoyl, alkylsulfoxide, arylsulfoxide, alkanesulfonyl, arenesulfonyl, amino, anilino, sulfonamido and sulfamoyl groups where the alkyl and aryl substituents and the alkyl and aryl portions of the alkoxy, aryloxy, alkylthio, arylthio, alkoxycarbonyl, arylcarbonyl, acyl, acyloxy, carbonamido, carbamoyl, alkanesulfonyl, arenesulfonyl, sulfonamido and sulfamoyl substituents contain 1 to 30 carbon atoms and 6 to 30 carbon atoms, respectively, and can be further substituted with such substituents.

Examples of useful tertiary carbon groups are:

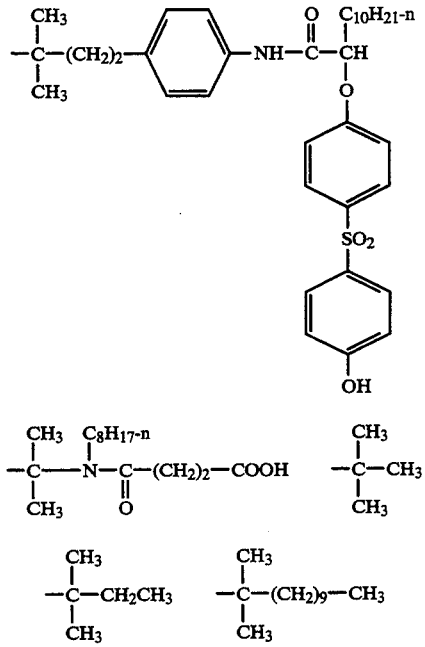

Another specific example of a group useful in the $R^3$ or $R^{21}$ positions defined above is phenoxyethoxy ($-O-CH_2CH_2-O-C_6H_5$).

The pyrazoloazole couplers employed according to the invention contain a coupling-off group. Examples of specific coupling-off groups include:

$-Cl$, $-F$, $-SCN$, $-OCH_3$, $-OCH_6H_5$, $-OCH_2CONHCH_2CH_2OH$, $-OCH_2CONHCH_2CH_2OCH_3$, $-OCH_2CONHCH_2CH_2OCOCH_3$, $-NHSO_2CH_3$, $-OSO_2CH_3$, $-S-(-CH_2-)_2-COOH$,

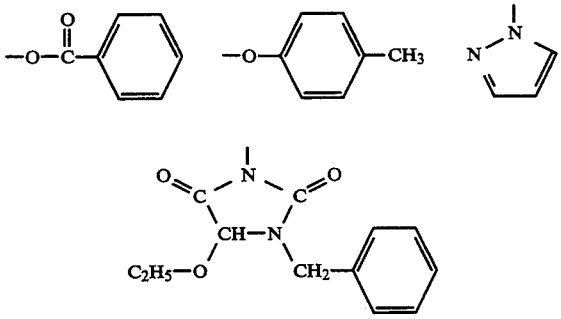

-continued

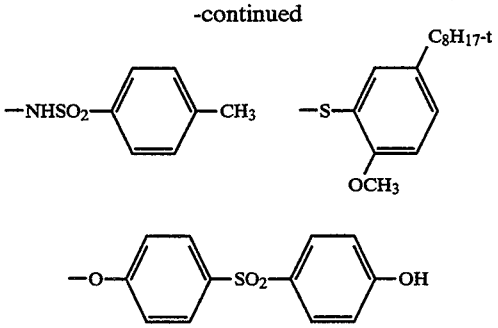

-continued

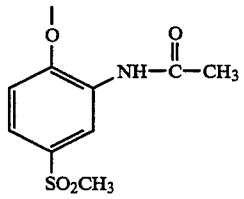

Pyrazoloazole couplers according to the invention are prepared by the general method of synthesis described in *Research Disclosure*, August 1974, Item No. 12443 published by Kenneth Mason Publications, Ltd., The Old Harbourmaster's, 8 North Street, Emsworth, Hampshire P010 7DD, England, and U.S. Pat. No. 4,540,654; European Patent Nos. EP 0 285 274, EP 0 428 902A1 or EP 0 459 349A1.

Preferred pyrazolotriazole couplers useful according to the invention are given below, without being limited thereto:

PA-1

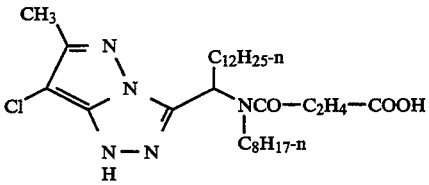

PA-2

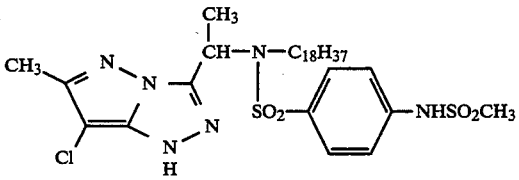

PA-3

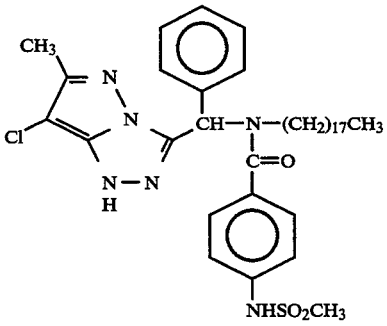

PA-4

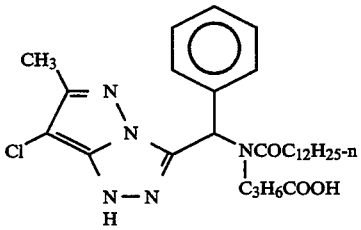

PA-5

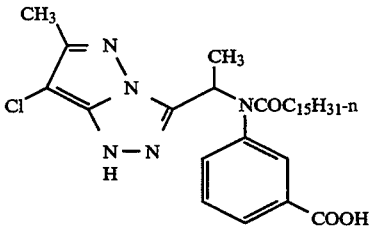

PA-6

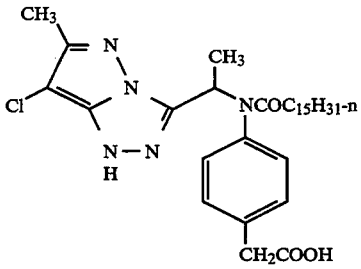

PA-7

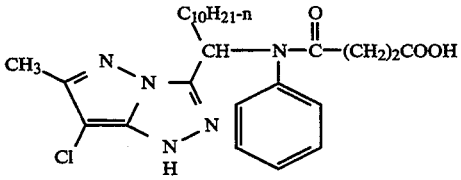

PA-8

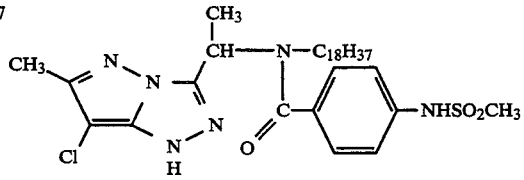

-continued
PA-9
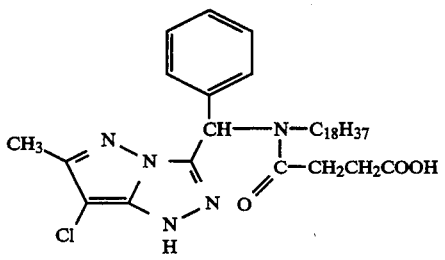
PA-10
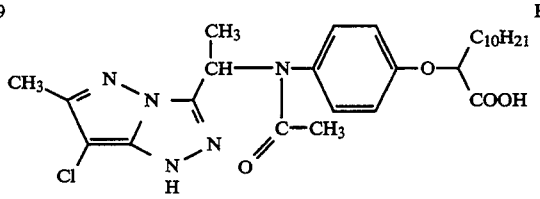
PA-11
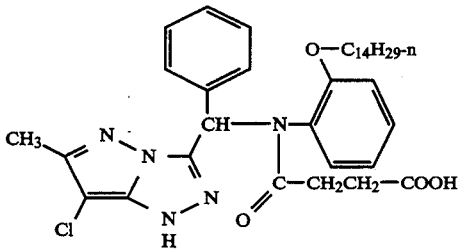
PA-12
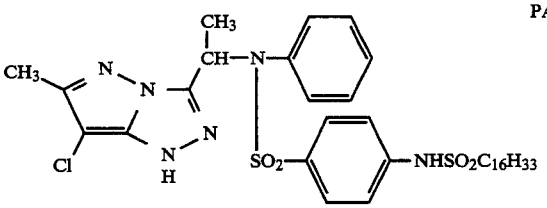
PA-13
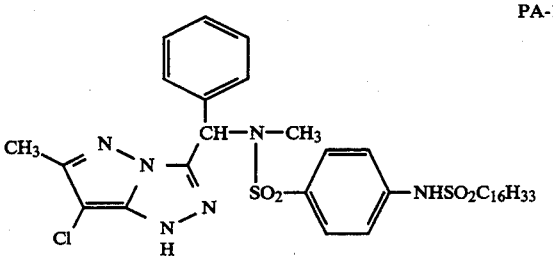
PA-14
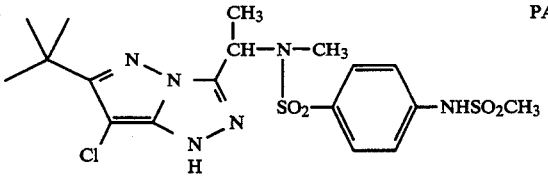
PA-15
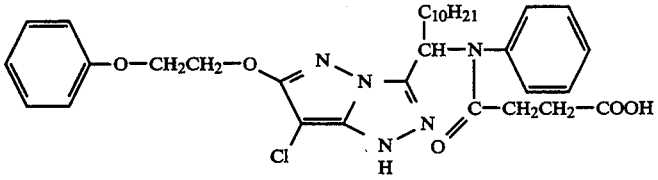
PA-16
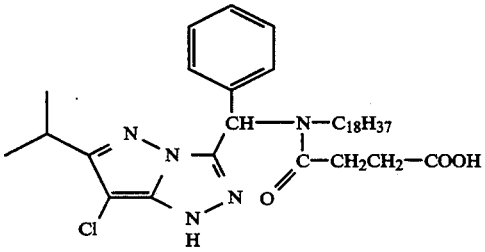
PA-17
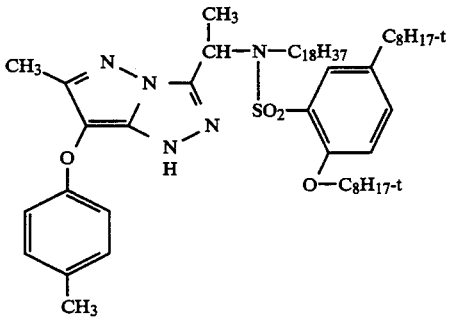
PA-18
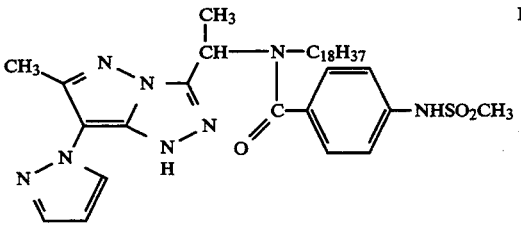
PA-19
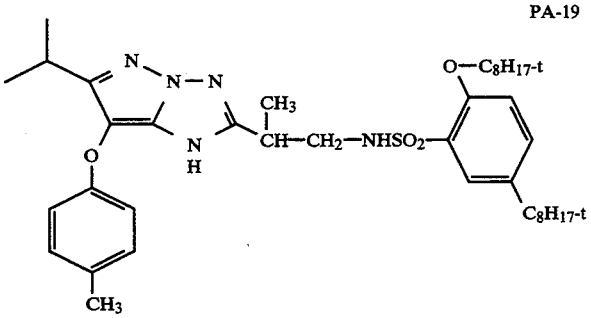

-continued
PA-20
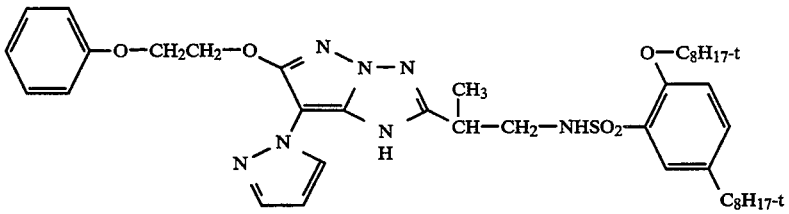
PA-21
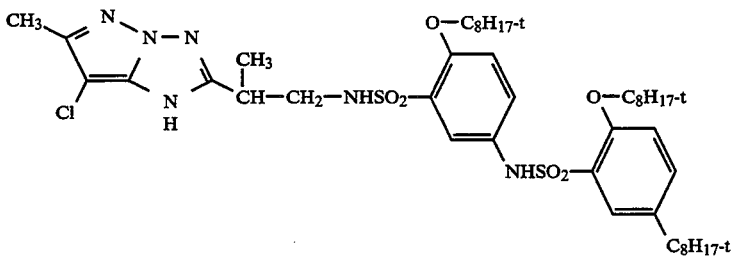
PA-22
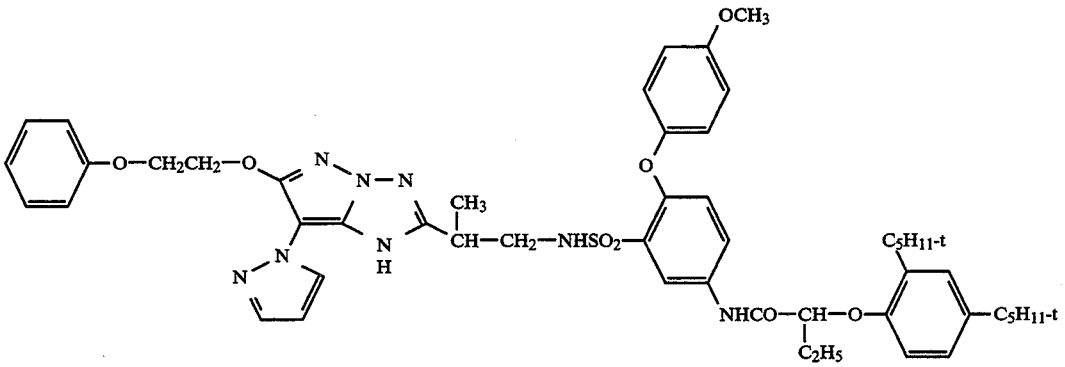
PA-23
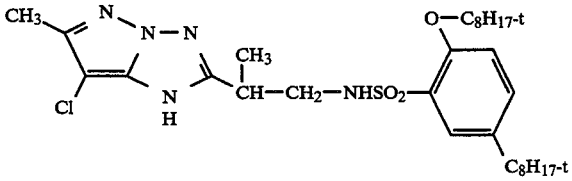
PA-24
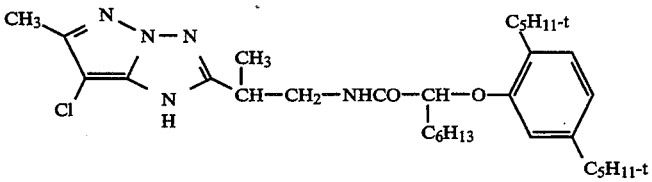
PA-25
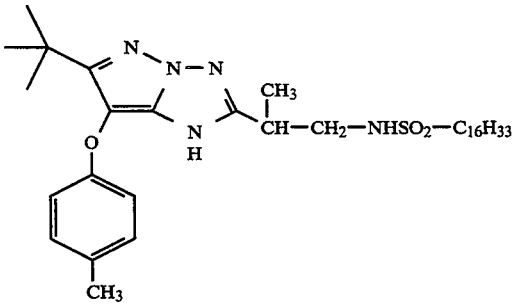

-continued

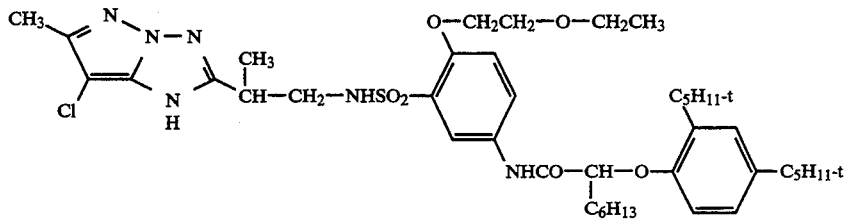

PA-26

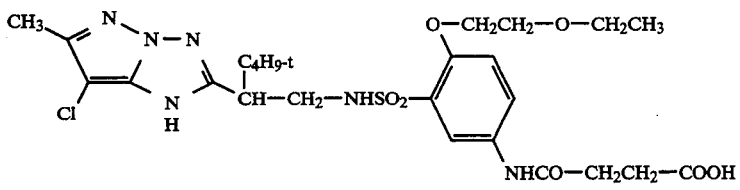

PA-27

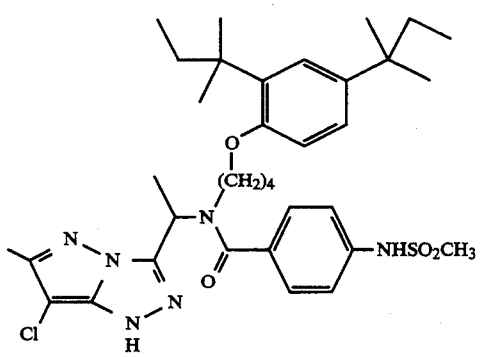

PA-28

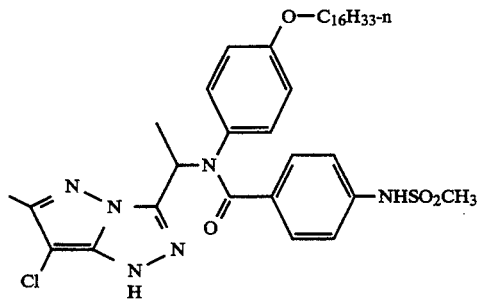

PA-29

The magenta couplers used in the fast and slower layers as described above can be either coated directly in the layers, or alternatively associated with the appropriate layer. Here, the term "associated" means that the couplers are incorporated in a silver halide layer or incorporated in a photographic element, such that during development the couplers will be able to react with silver halide development products.

The photographic elements in which the couplers and molecules of this invention are employed can be either single- or multi-color elements, the only requirement being that at least two green-sensitive silver halide emulsion layers of different speeds be incorporated into the element. Multi-color elements contain dye image-forming units sensitive to each of the three primary regions of the spectrum. Each unit can comprise a single emulsion layer or multiple emulsion layers sensitive to a given region of the spectrum. The layers of the element, including the layers of the image-forming units, can be arranged in various orders as known in the art.

A typical multi-color photographic element comprises a support bearing a cyan dye image-forming unit comprising at least one red-sensitive silver halide emulsion layer having associated therewith at least one cyan dye-forming coupler, a magenta image forming unit comprising, according to the invention, at least two green-sensitive silver halide emulsion layers each having associated therewith a magenta dye-forming coupler as described above, and a yellow dye image-forming unit comprising at least one blue-sensitive silver halide emulsion layer having associated therewith at least one yellow dye-forming coupler. The element can contain additional layers, such as filter layers, interlayers, overcoat layers, subbing layers, and the like.

In the following discussion of suitable materials for use in the emulsions and elements according to the invention, reference will be made to Research Disclosure, December 1989, Item 308119, published by Kenneth Mason Publications, Ltd., Emsworth, Hampshire P010 7DQ, U.K., the disclosures of which are incorporated herein in their entireties by reference. This publication will be identified hereafter as "Research Disclosure". The elements of the invention can comprise emulsions and additives described in these publications and publications referenced therein.

The silver halide emulsions employed in the elements according to the invention can comprise silver bromide, silver chloride, silver iodide, silver chlorobromide, silver chloroiodide, silver bromoiodide, silver chlorobromoiodide or mixtures thereof. The emulsions can include silver halide grains of any conventional shape or size. Specifically, the emulsions can include coarse, medium, or fine silver halide grains. High aspect ratio tabular grain emulsions are specifically contemplated, such as those disclosed in U.S. Pat. Nos. 4,386,156, 4,399,215, 4,400,463, 4,414,306, 4,414,966, 4,424,310, 4,433,048, 4,434,226, 4,435,501, 4,504,570, 4,672,027, and 4,693,964. Also specifically contemplated are those silver bromoiodide grains with a higher molar proportion of iodide in the core of the grain than in the periphery of the grain, such as those described in U.K. Patent No. 1,027,146; Japanese Patent No. 54/48521; U.S. Pat. Nos. 4,379,837, 4,444,877, 4,565,778, 4,636,461, 4,665,012, 4,668,614, 4,686,178, and 4,728,602; and in European Patent No. 264,954. The silver halide emulsions can be either monodisperse or polydisperse as precipitated. The grain size distribution of the emulsions can be controlled by silver halide grain separation techniques or by blending silver halide emulsions of differing grain sizes.

Sensitizing compounds, such as compounds of copper, thallium, lead, bismuth, cadmium and Group VIII noble metals, can be present during precipitation of the silver halide emulsion.

The emulsions can be surface-sensitive emulsions, that is, emulsions that form latent images primarily on the surfaces of the silver halide grains, or internal latent image-forming emulsions, that is, emulsions that form latent images predominantly in the interior of the silver halide grains. The emulsions can be negative-working emulsions, such as surface-sensitive emulsions or unfogged internal latent image-forming emulsions, or direct-positive emulsions of the unfogged, internal latent image-forming type, which are positive-working when development is conducted with uniform light exposure or in the presence of a nucleating agent.

The silver halide emulsions can be surface sensitized, noble metal (for example, gold), middle chalcogen (such as sulfur, selenium or tellurium), and reduction sensitizers, employed individually or in combination, are specifically contemplated. Typical chemical sensitizers are listed in Research Disclosure, Item 308119, Section III.

The silver halide emulsions can be spectrally sensitized with dyes from a variety of classes, including the polymethine dye class, which includes the cyanines, merocyanines, complex cyanines and merocyanines (such as tri-, tetra- and polynuclear cyanines and merocyanines), oxonols, hemioxonols, styryls, merostyryls and streptocyanines. Illustrative spectral sensitizing dyes are described in Research Disclosure, Item 308119, Section IV and the publications cited therein.

Suitable vehicles for the emulsion layers and other layers of the elements according to the invention are described in Research Disclosure, Item 308119, Section IX and the publications cited therein.

The photographic elements according to the invention can include additional couplers such as those described in Research Disclosure Section VII, paragraphs D–G and the publications cited therein. These additional couplers can be incorporated as described in Research Disclosure Section VII, paragraph C and the publications cited therein. The element according to the invention can contain colored masking couplers such as described in U.S. Pat. No. 4,883,746, with image modifying couplers such as described in U.S. Pat. Nos. 3,148,062, 3,227,554, 3,733,201, 4,409,323, and 4,248,962 and with couplers that release bleach accelerators such as described in European Patent Application No. 193,389.

A photographic element according to the invention, or individual layers thereof, can also include any of a number of other well-known additives and layers. These include, for example, optical brighteners (see Research Disclosure Section V), antifoggants and image stabilizers (see Research Disclosure Section VI), light-absorbing materials such as filter layers of intergrain absorbers, and light-scattering materials (see Research Disclosure Section VIII), gelatin hardeners (see Research Disclosure Section X), oxidized developer scavengers, coating aids and various surfactants, overcoat layers, interlayers, barrier layers and antihalation layers (see Research Disclosure Section VII, paragraph K), antistatic agents (see Research Disclosure Section XIII), plasticizers and lubricants (see Research Disclosure Section XII), matting agents (see Research Disclosure Section XVI), antistain agents and image dye stabilizers (see Research Disclosure Section VII, paragraphs I and J), development-inhibitor releasing couplers and bleach accelerator-releasing couplers (see Research Disclosure Section VII, paragraph F), development modifiers (see Research Disclosure Section XXI), and other additives and layers known in the art.

The photographic elements according to the invention can be coated on a variety of supports as described in Research Disclosure Section XVII and the references cited therein. These supports include polymeric films, such as cellulose esters (for example, cellulose triacetate and diacetate) and polyesters of dibasic aromatic carboxylic acids with divalent alcohols (such as polyethylene terephthalate), paper, and polymer-coated paper.

Photographic elements according to the invention can be exposed to actinic radiation, typically in the visible region of the spectrum, to form a latent image as described in Research Disclosure Section XVIII, and then processed to form a visible dye image as described in Research Disclosure Section XIX. Processing to form a visible dye image includes the step of contacting the element with a color developing agent to reduce developable silver halide and oxidize the color developing agent. The oxidized color developing agent in turn reacts with the coupler to yield a dye.

Preferred color developing agents are p-phenylene diamines. Especially preferred are 4-amino-3-methyl-N,N-diethylaniline hydrochloride, 4-amino-3-methyl-N-ethyl-N-$\beta$-(methanesulfonamido)-ethylaniline sulfatehydrate, 4-amino-3-methyl-N-ethyl-N-$\beta$-hydroxyethylaniline sulfate, 4-amino-3-$\beta$-(methanesulfonamido)ethyl-N,N-diethylaniline hydrochloride and 4-amino-N-ethyl-N-(2-methoxyethyl)-m-toluidine-di-p-toluenesulfonic acid.

With negative-working silver halide, the process step described above leads to a negative image. The described elements are preferably processed in the known C-41 color process as described in, for example, the British Journal of Photography Annual of 1988, pages 196–98. To obtain a positive (or reversal) image, the color development step can be preceded by development with a non-chromogenic developing agent to develop exposed silver halide but not form dye, and then uniformly fogging the element to render unexposed silver halide developable, followed by development with a chromogenic developer. Alternatively, a direct-positive emulsion can be employed to obtain a positive image.

The pyrazolone couplers employed according to the instant invention can also be used in combination with various amine addenda to control continued coupling, as disclosed in. U.S. Pat. Nos. 4,483,918, 4,555,479, and 4,585,728.

Development is followed by the conventional steps of bleaching, fixing, or bleach-fixing, to remove silver and silver halide, washing and drying. Bleaching and fixing can be performed with any of the materials known to be used for that purpose. Bleach baths generally comprise an aqueous solution of an oxidizing agent such as water soluble salts and complexes of iron (III) (such as potassium ferricyanide, ferric chloride, ammonium or potassium salts of ferric ethylenediaminetetraacetic acid), water-soluble dichromates (such as potassium, sodium, and lithium dichromate), and the like. Fixing baths generally comprise an aqueous solution of compounds that form soluble salts with silver ions, such as sodium thiosulfate, ammonium thiosulfate, potassium thiocyanate, sodium thiocyanate, thioureas, and the like.

The invention is further illustrated by the following examples, without being limited thereby.

EXAMPLE 1

Determination of Relative Coupler Activity by CZA

Single layer photographic elements are prepared by coating a cellulose acetate-butyrate film support with a photosensitive layer containing a silver bromide emulsion at 0.45 g/m$^2$, gelatin at 3.78 g/m$^2$ and an image coupler (1.6 mmol/m$^2$) dispersed in an indicated weight of coupler solvent.

The photosensitive layer is overcoated with a layer containing gelatin at 2.69 g/m$^2$ and bis-vinylsulfonylmethyl ether hardner at 1.75 wt % based on the total weight of the gelatin.

Samples of each element are exposed imagewise through a graduated density test object and processed at 100° F. according to the following process, wither with or without the use of citrazinic acid (CZA). The following sequence of processing solutions is employed: development, 3 min 15 sec; low pH stop bath (3% acetic acid), 2 min; bleach, 4 min; wash, 1 min; fix, 4 min; wash, 4 min; dry. The developer, bleach and fix solutions are described in Tables I–III following.

TABLE I

| Developer Solution | |
|---|---|
| Anhydrous potassium carbonate | 37.50 g |
| Anhydrous sodium sulfite | 4.25 g |
| Potassium iodide | 0.02 g |
| Sodium bromide | 1.30 g |
| Hydroxylamine sulfate | 2.00 g |
| 4-Amino-3-methyl-N-ethyl-N-B'-hydroxyethylanilinesulfate | 3.55 g |
| Citrazinic acid (CZA) (optional) | 4.00 g |
| Water to make 1 liter, pH 10.0 | |

TABLE II

| Bleach Solution | |
|---|---|
| Ammonium bromide | 150.00 g |
| Ammonium ferric EDTA (1.56M) | 175.00 ml |
| Acetic acid | 9.50 ml |
| Sodium nitrate | 35.00 g |
| Water to make 1 liter, pH 6.00 | |

TABLE III

| Fix Solution | |
|---|---|
| Ammonium thiosulfate (58%) | 214.00 g |
| (Ethylenedinitrilo)tetraacetic acid, disodium salt | 1.29 g |
| Sodium metabisulfite | 11.00 g |
| Sodium hydroxide (50%) | 4.70 g |
| Water to make 1 liter, pH 6.50 | |

Densitometry provides a measure of gamma, defined as the maximum slope between any two adjacent density points, for the processes with and without CZA. The ratio [Gamma(+CZA)/Gamma(−CZA)]×100 provides a measure of the activity of the coupler toward Dox in the presence of a Dox competitor. A higher ratio indicates that the coupler is more able to react with Dox compared to CZA, and thus is expected to display higher activity in a highly competitive multilayer film environment.

The foregoing procedure was used to determine the relative rates of a number of magenta couplers as shown in Table IV below.

TABLE IV

| Pyrazolones | | |
|---|---|---|
| Compound | Ratio, Compound:Solvent | Relative Rate |
| P-1 | 1:1 A | 47.2 |
| P-2 | 1:1 A | 52.4 |
| P-3 | 1:1 A | 46.0 |
| P-4 | 1:1 A | 52.0 |
| P-5 | 1:1 A | 53.0 |
| P-6 | 1:1 A | 58.0 |
| P-7 | 1:0.8 B:0.2 C | 37.0 |
| P-8 | 1:0.75 B:0.25 C | 43.0 |
| P-9 | 1:1 B | 25.0 |
| P-10 | 1:1 B | 46.0 |
| P-11 | 1:0.8 B:0.2 C | 40.0 |
| P-12 | 1:0.8 B:0.2 C | 44.0 |
| P-13 | 1:1 B | 39.0 |

TABLE IV

| Pyrazoloazoles | | |
|---|---|---|
| Compound | Ratio, Compound:Solvent | Relative Rate |
| PA-1 | 1:0.5 A | 50.6 |
| PA-2 | 1:0.5 A | 56.3 |
| PA-3 | 1:0.5 A | 37.0 |
| PA-4 | 1:0.5 A | 56.9 |
| PA-5 | 1:0.5 A | 68.8 |
| PA-6 | 1:0.5 A | 94.1 |

A = Phosphoric acid tri(methylphenyl) ester
B = N,N-dibutyllauramide
C = N,N-dibutyl-2-butyloxy-5-tert.-octylaniline

EXAMPLE 2

Experimental

The multilayer color photographic elements were prepared in the following format. Although the green record of the examples here were triple-coated, the double-coated green record format was found to work just as well. In the examples the following compounds were used:

Cyan dye-forming coupler

C-1

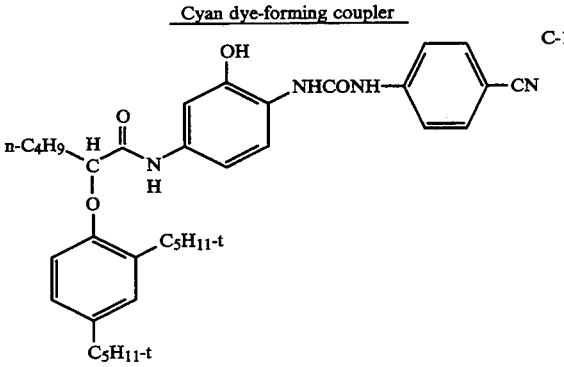

Magenta dye-forming couplers

PA-1

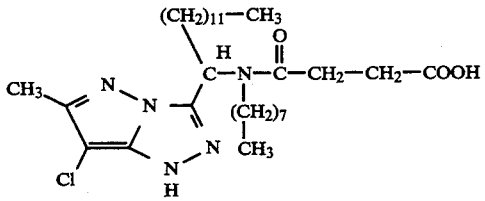

-continued
PA-2
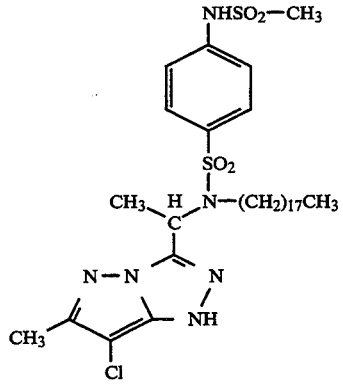
PA-3
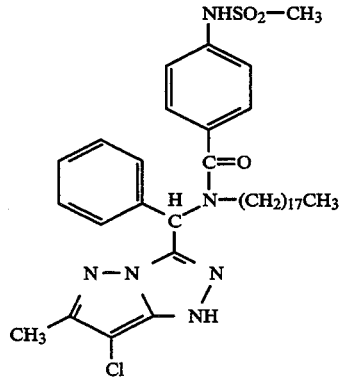
P-1
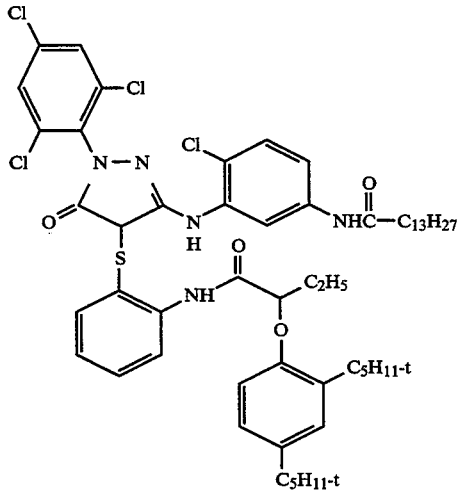
-continued
P-2
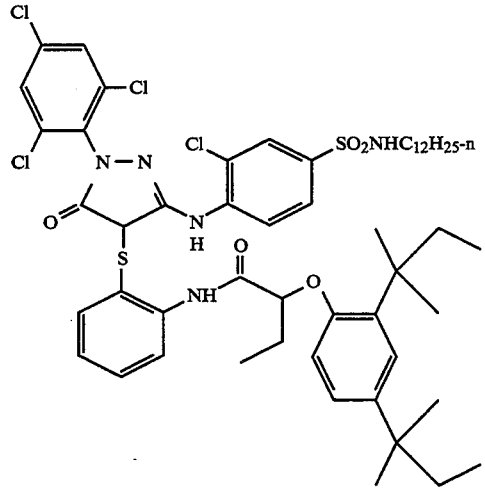
Yellow dye-forming couplers
Y-1
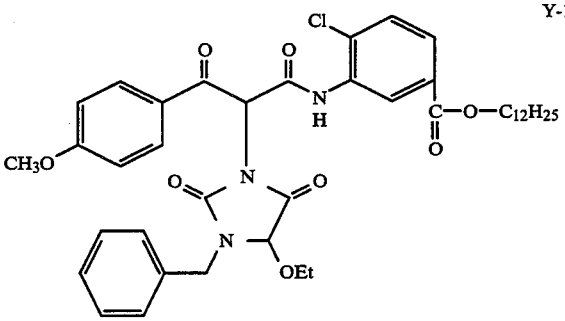
Y-2
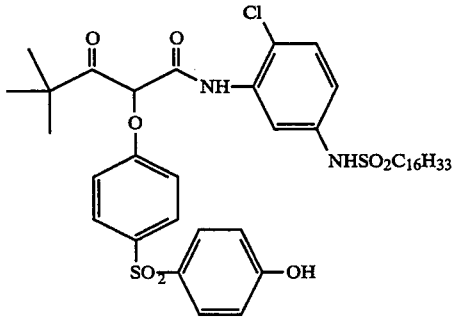
DIR couplers
DIR-1
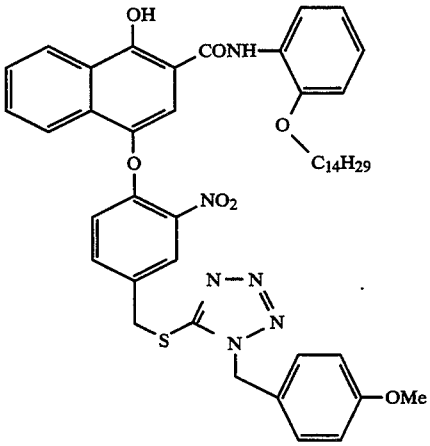

-continued
DIR-2
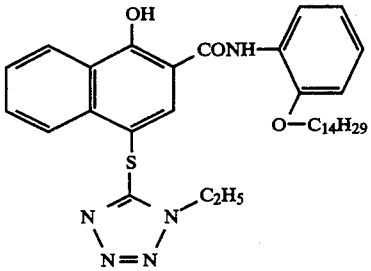
DIR-3
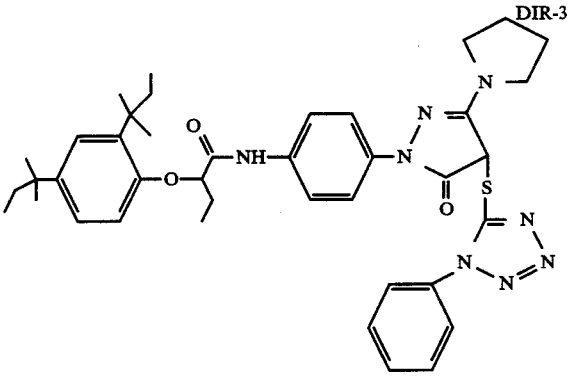
DIR-4
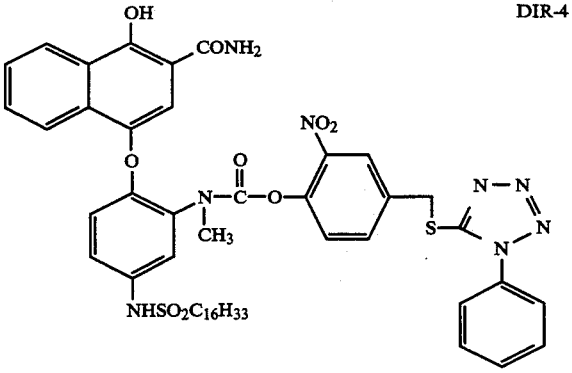
DIR-5
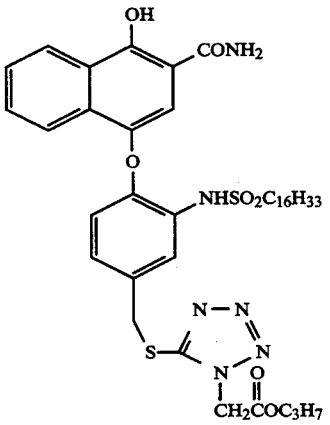
-continued
DIR-6
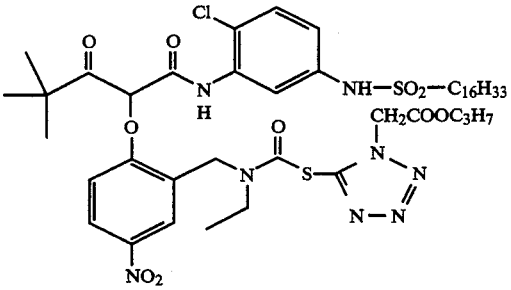
DIR-7
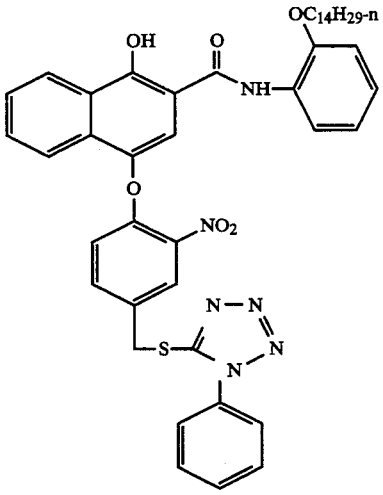
DIR-8
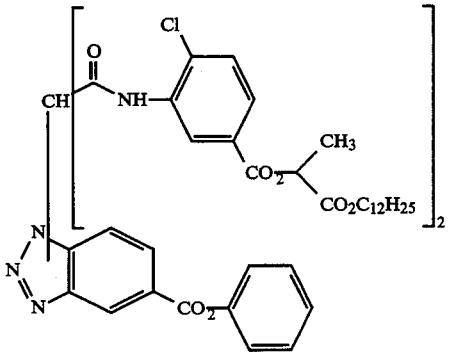
Bleach accelerator releasing coupler
B-1
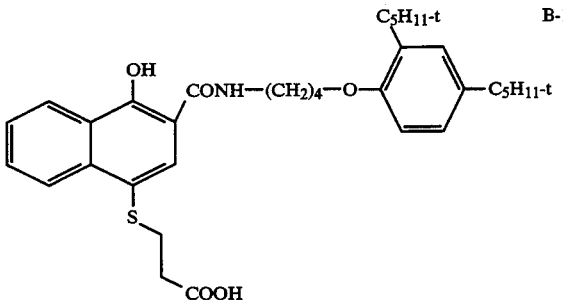
Oxidized developer scavenger -continued

S-1

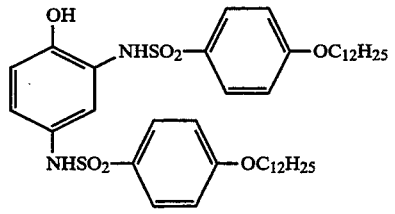

Yellow Dye

YD-2

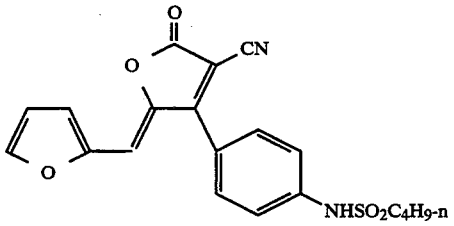

UV Dyes

UV-1

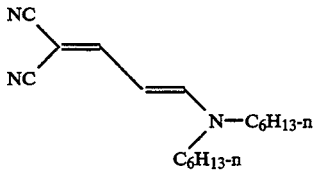

UV-2

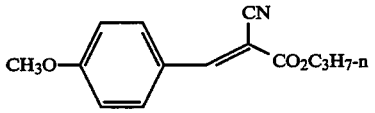

Masking couplers

MC-1

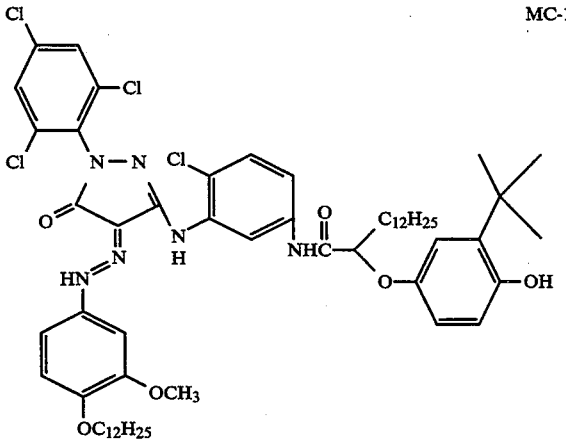

-continued

MC-2

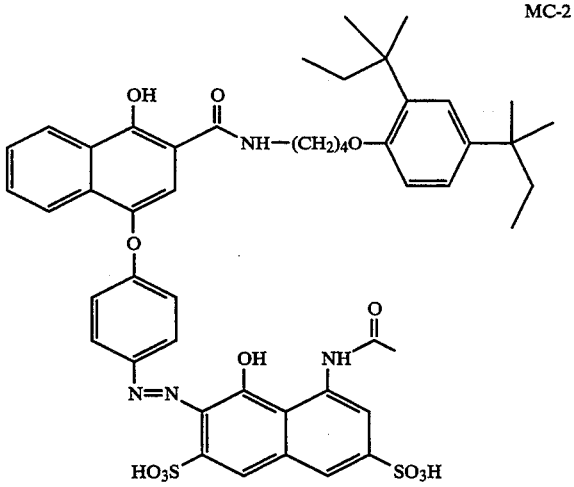

MC-3

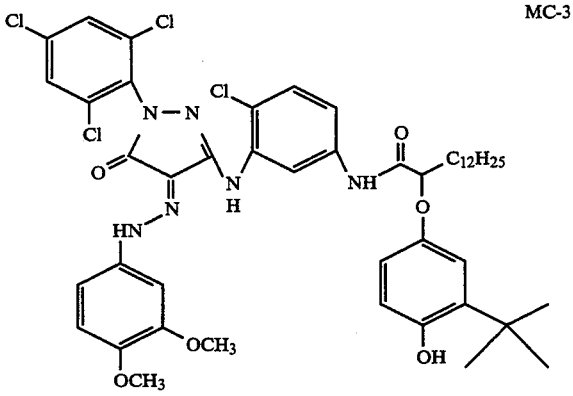

Comparative Example 1

A photographic element was produced by coating the following layers on a cellulose triacetate film support:

Layer 1 (antihalation layer): black colloidal silver sol containing silver at 0.323 g/m$^2$ and gelatin at 2.691 g/m$^2$.

Layer 2 (slow cyan layer): a blend of two red-sensitized silver iodobromide grains: (i) a medium sized tabular emulsion (3.0 mole % iodide) at 1.49 g/m$^2$, and (ii) a smaller cubic emulsion (3.5 mole % iodide) at 1.08 g/m$^2$; gelatin at 3.0 g/m$^2$; cyan dye-forming coupler C-1 at 0.87 g/m$^2$; DIR coupler DIR-1 at 0.065 g/m$^2$; bleach accelerator releasing coupler B-1 at 0.01 g/m$^2$; and antifoggant 4-hydroxy-6-methyl-1,3,3a,7-tetraazaindene at 0. 036 g/m$^2$.

Layer 3 (fast cyan layer): a red-sensitized tabular silver iodobromide emulsion (6.0 mole % iodide) at 0.81 g/m$^2$; cyan dye-forming coupler C-1 at 0.151 g/m$^2$; DIR couplers DIR-1 at 0.065 g/m$^2$ and DIR-2 at 0.032 g/m$^2$; gelatin at 1.68 g/m$^2$; and antifoggant 4-hydroxy-6-methyl-1,3,3a,7-tetraazaindene at 0.036 g/m$^2$.

Layer 4 (interlayer): oxidized developer scavenger S-1 at 0.054 g/m$^2$ and gelatin at 1.3 g/m$^2$.

Layer 5 (slow magenta layer): a blend of two green-sensitized tabular silver iodobromide emulsions: (i) 3.0 mole % iodide at 0.44 g/m$^2$, and (ii) 1.5 mole % iodide at 0.44 g/m$^2$; magenta dye-forming coupler P-1 at 0.10 g/m$^2$; DIR coupler DIR-3 at 0.022 g/m$^2$; masking coupler MC-1 at 0.065 g/m$^2$; gelatin at 1.29 g/m$^2$; and antifoggant 4-hydroxy-6-methyl-1,3,3a,7-tetraazaindene at 0.036 g/m$^2$.

Layer 6 (mid magenta layer): a green-sensitized tabular silver iodobromide emulsion (3.0 mole % iodide) at 0.59 g/m$^2$; magenta dye-forming coupler P-1 at 0.098 g/m$^2$; DIR couplers DIR-4 at 0.0269 g/m$^2$ and DIR-5 at 0.0032 g/m$^2$; masking coupler MC-1 at 0.043 g/m$^2$; gelatin at 1.23 g/m$^2$; and antifoggant 4-hydroxy-6-methyl-1-3,3a,7-tetraazaindene at 0.036 g/m$^2$.

Layer 7 (fast magenta layer): a green-sensitized tabular silver iodobromide emulsion (3.0 mole % iodide) at 0,754 g/m$^2$; magenta dye-forming coupler P-1 at 0.101 g/m$^2$; masking coupler MC-1 at 0.054 g/m$^2$; DIR coupler DIR-3 at 0.0215 g/m$^2$; gelatin at 1.40 g/m$^2$; and antifoggant 4-hydroxy-6-methyl-1,3,3a,7-tetraazaindene at 0.036 g/m$^2$ Layer 8 (yellow filter layer): gelatin at 0.86 g/m$^2$, Carey Lea silver at 0.043 g/m$^2$, and oxidized developer scavenger S-1 at 0.054 g/m$^2$.

Layer 9 (slow yellow layer): a blue-sensitized tabular silver iodobromide emulsion (3.0 mole % iodide) at 0.36 g/m$^2$; a blue-sensitized tabular silver bromoiodide emulsion (3.0 mole % iodide) at 0.10 g/m$^2$; yellow dye-forming coupler Y-1 at 0.883 g/m$^2$; DIR coupler DIR-6 at 0.097 g/m$^2$; and gelatin at 1.73 g/m$^2$.

Layer 10 (fast yellow layer): a blue-sensitized tabular silver iodobromide emulsion (3.0 mole % iodide) at 0.43 g/m$^2$; yellow dye-forming coupler Y-1 at 0.513 g/m$^2$; DIR coupler DIR-6 at 0.032 g/m$^2$; and gelatin at 0.807 g/m$^2$.

Layer 11 (protective overcoat and UV filter layer): gelatin-at 1.24 g/m$^2$ ; silver bromide Lippmann emulsion at 0.23 g/m$^2$; UV absorbers at 0.23 g/m$^2$; and bis(-vinylsulfonyl)methane added at 1.8% of total gelatin weight.

Surfactants, coating aids, soluble absorber dyes, emission stabilizers and inert tinting dyes were added to various layers where appropriate as commonly practiced in the art.

Comparative Example 2

A second photographic element, designated Example 2, was prepared in a similar manner to Example 1. The following modifications were made:

The pyrazole coupler P-1 was replaced with a pyrazolotriazole coupler PA-1 in Layer 7 (fast magenta layer) at 0.129 g/m$^2$, Layer 6 (mid magenta layer) at 0.102 g/m$^2$, and Layer 5 (slow magenta layer) at 0.210 g/m$^2$.

Comparative Example 3

A third photographic element, designated Example 3, was prepared in a similar manner to Example 1. The following modifications were made:

The pyrazole coupler P-1 was replaced with a pyrazolotriazole coupler PA-2 in Layer 7 (fast magenta layer) at 0.0801 g/m$^2$, Layer 6 (mid magenta layer) at 0.0861 g/m$^2$, and Layer 5 (slow magenta layer) at 0.156 g/m$^2$. The magenta DIR in Layer 7 was increased to 0.0269 g/m$^2$.

Comparative Example 4

A fourth photographic element, designated Example 4, was prepared in a similar manner to Example 3. The following modifications were made:

The magenta dye-forming coupler PA-2 in Layer 5 was replaced with PA-3 at 0.388 g/m$^2$. Likewise, the magenta dye-forming coupler PA-2 in Layer 6 was replaced with PA-3 at 0.183 g/m$^2$.

Example 5 (Invention)

A fifth photographic element, designated Example 5, was prepared in a similar manner to Example 4. The following modifications were made:

The magenta dye-forming coupler PA-2 in Layer 7 was replaced with P-1 at 0.101 g/m$^2$.

Example 6 (Invention)

A sixth photographic element, designated Example 6, was prepared in a similar manner to Example 4. The following modifications were made:

The magenta dye-forming coupler PA-2 in Layer 7 was replaced with P-2 at 0.095 g/m$^2$.

The sensitivity of each photographic element to process pH was determined as follows. The pH and sodium bromide concentration of the development process were varied for each element. The center point of sodium bromide is 1.3 g/l with other four levels of 0.5 g/l, 0.8 g/l, 1.8 g/l, and 2.1 g/l. The center point of pH is 10.05 with other four levels of 9.90, 9.95, 10.15, and 10.20.

With the developer makeup as stated here, the neutrally exposed films were processed with tail-end steps of standard C41 Process. The impact on the underexposure color balance of the two sigma weighted trade variability by pH value is multiplied by 100 to yield the pH sensitivity of the tested film.

As used herein, the "two sigma weighted trade variability" denotes variation of the major components of the developer solution within a range encompassing approximately 95% of the developer formulations employed by the photofinishing trade. This provides a measurement of the "real world" variability within the trade. As used in Table V below, "relative green granularity" pertains to the observed change in $\sigma_D$. Each 5% change in $\sigma_D$ of the green record represents one granularity unit (GU) (see James, p. 619). The "−1" relative green granularity denotes the "one step underexposure" granularity.

Relative green speed is the speed relative to the Control Example 1.

Gamma (G) is green gamma at a neutral exposure. C stands for comparative example.

Photographic Data

| EXAMPLE | MAGENTA COUPLER FM/MM/SM | RELATIVE GREEN SPEED Gn | GAMMA (G) | SENSITIVITY TO PROCESS pH | RELATIVE GREEN GRANULARITY '−1' (GU) |
|---|---|---|---|---|---|
| 1 (c) | P-1/P-1/P-1 | 1 | 0.53 | 0.3 | 0 |
| 2 (c) | PA-1/PA-1/PA-1 | 0.993 | 0.62 | 4.0 | +2 |
| 3 (c) | PA-2/PA-2/PA-2 | 0.988 | 0.55 | 4.9 | 0 |
| 4 (c) | PA-2/PA-3/PA-3 | 0.988 | 0.57 | 2.5 | −1 |
| 5 | P-1/PA-3/PA-3 | 1 | 0.58 | 1.4 | −2 |

-continued

| EXAMPLE | MAGENTA COUPLER FM/MM/SM | Photographic Data RELATIVE GREEN SPEED Gn | GAMMA (G) | SENSITIVITY TO PROCESS pH | RELATIVE GREEN GRANULARITY '−1' (GU) |
|---|---|---|---|---|---|
| 6 | P-2/PA-3/PA-3 | 0.990 | 0.59 | 1.1 | −2 |

As can be seen from Table V, all the tested coatings have similar green-of-neutral contrast and speed. The three comparative coatings with the same magenta dye-forming couplers in all three green layers (Examples 1 to all have higher granularity than the three coatings having mixed magenta couplers (Examples 4 to 6). The coating having PA-2 as the fast magenta coupler (Example 4), however, has much higher developer processing pH sensitivity than the two coatings according to the invention (Examples 5 and 6).

In examples 7–11, additional compounds as shown were employed in producing photographic elements:

Photographic elements were produced by coating the following layers on a cellulose triacetate film support (coverages are in grams per meter squared). The type and laydown of the magenta image couplers are shown in Table VI. Examples 7 and 10 are comparisons:

Layer 1 (antihalation layer): black colloidal silver sol containing silver at 0.151 g/m$^2$, and gelatin at 2.44 g/m$^2$.

Layer 2 (slow cyan layer): a blend of two red-sensitized tabular silver iodobromide grains: (i) 0.50 microns diameter by 0.08 microns thick (1.3 mole % iodide) at 0.463 g/m$^2$, and (ii) 1.00 microns diameter by 0.09 microns thick (4.5 mole % iodide) at 0.473 cyan dye-forming coupler C-1 at 0.54 g/m$^2$; bleach accelerator releasing coupler B-1 at 0.04 g/m$^2$; and gelatin at 1.78 g/m$^2$.

Layer 3 (intermediate cyan layer): a red-sensitized tabular silver iodobromide emulsion, 1.31 microns diameter by 0.12 microns thick (4.5 mole % iodide) at 0.70 g/m$^2$; cyan dye-forming coupler C-1 at 0.23 g/m$^2$; cyan dye-forming masking coupler MC-2 at 0.022 g/m$^2$; DIR coupler DIR-7 at 0.011 g/m$^2$; and gelatin at 1.66 g/m$^2$.

Layer 4 (fast cyan layer): a red-sensitized tabular silver iodobromide emulsion, 2.70 microns diameter by 0.13 microns thick (4.5 mole % iodide) at 1.08 g/m$^2$; cyan dye-forming coupler C-1 at 0.124 g/m$^2$; cyan dye-forming masking coupler MC-2 at 0.032 g/m$^2$; DIR coupler DIR-2 at 0.05 g/m$^2$; DIR coupler DIR-7 at 0.024 g/m$^2$; and gelatin at 1.36 g/m$^2$.

Layer 5 (interlayer): gelatin at 1.29 g/m$^2$.

Layer 6 (slow magenta layer): a blend of two green-sensitized tabular silver iodobromide emulsions: (i) 0.54 microns diameter by 0.08 microns thick (1.3 mole % iodide) at 0.602 g/m$^2$, and (ii) 1.03 microns diameter by 0.09 microns thick (4.5 mole % iodide) at 0.3 g/m$^2$; magenta dye-forming coupler as indicated in Table VI; masking coupler MC-3 at 0.065 g/m$^2$; and gelatin at 1.78 g/m$^2$.

Layer 7 (intermediate magenta layer): a green-sensitized tabular silver iodobromide emulsion, 1.22 microns diameter by 0.11 microns thick (4.5 mole % iodide) at 0.97 g/m$^2$; magenta dye-forming coupler as indicated in Table VI; masking coupler MC-1 at 0.064 g/m$^2$; DIR coupler D-7 at 0.024 g/m$^2$; and gelatin at 1.48 g/m$^2$.

Layer 8 (fast magenta layer): a green-sensitized tabular silver iodobromide emulsion, 2.23 microns diameter by 0.13 microns thick (4.5 mole % iodide) at 0.97 g/m$^2$; magenta dye-forming coupler as indicated in Table VI; masking coupler MC-3 at 0.054 g/m$^2$; DIR coupler DIR-3 at 0.01 g/m$^2$; DIR coupler DIR-9 at 0.008 g/m$^2$; and gelatin at 1.40 g/m$^2$.

Layer 9 (yellow filter layer): yellow dye material YD-2 at 0.11 g/m$^2$, and gelatin at 1.33 g/m$^2$.

Layer 10 (slow yellow layer): a blend of two blue-sensitized tabular silver iodobromide emulsions: (i) 1.02 microns diameter by 0.09 microns thick (4.5 mole % iodide) at 0.24 g/m$^2$, and (ii) 1.38 microns diameter by 0.11 microns thick (4.5 mole % iodide) at 0.59 g/m$^2$; yellow dye-forming coupler Y-2 at 0.70 g/m$^2$; yellow coupler Y-1 at 0.28 g/m$^2$; DIR coupler DIR-6 at 0.06 g/m$^2$; bleach accelerator releasing coupler B-1 at 0.003 g/m$^2$; cyan coupler C-1 at 0.016 g/m$^2$; and gelatin at 2.60 g/m$^2$.

Layer 11 (fast yellow layer): a blue-sensitized conventional 3-D grain, silver iodobromide emulsion (12 mole % iodide, 1.0 micron) at 0.22 g/m$^2$ and a blue-sensitized tabular silver iodobromide emulsion, 3.53 microns diameter by 0.14 microns thick (4.5 mole % iodide) at 0.57 g/m$^2$; yellow dye-forming coupler Y-2 at 0.22 g/m$^2$; yellow coupler Y-1 at 0.087 g/m$^2$; DIR coupler DIR-6 at 0.049 g/m$^2$; bleach accelerator releasing coupler B-1 at 0.005 g/m$^2$; cyan coupler C-1 at 0.021 g/m$^2$; and gelatin at 1.97 g/m$^2$.

Layer 12 (UV filtration layer): dye UV-1 at 0.11 g/m$^2$; dye UV-2 at 0.11 g/m$^2$; unsensitized silver bromide Lippmann emulsion at 0.22 g/m$^2$; and gelatin at 1.11 g/m$^2$.

Layer 13 (protective layer): gelatin at 0.92 g/m$^2$ and matte polymethylmethacrylate beads at 0.054 g/m$^2$.

The film was hardened at coating with 1.75% by weight of total gelatin of bis(vinylsulfonyl)methane. Conventional surfactants, coating aids, oxidized developer scavengers, soluble absorber dyes, inert tinting dyes, and stabilizers were added to the various layers of the examples, as appropriate as practiced in the art.

TABLE VI

| EXAMPLE | Magenta Couplers FAST GREEN LAYER COUPLER | FAST GREEN LAYER LAYDOWN | INTERMEDIATE GREEN LAYER COUPLER | INTERMEDIATE GREEN LAYER LAYDOWN | SLOW GREEN LAYER COUPLER | SLOW GREEN LAYER LAYDOWN |
|---|---|---|---|---|---|---|
| 7 (c) | PA-1 | 0.070 | P-1 | 0.077 | P-1 | 0.027 |
| 8 | PA-2 | 0.075 | P-1 | 0.077 | P-1 | 0.027 |
| 9 | PA-5 | 0.050 | P-1 | 0.077 | P-1 | 0.027 |
| 10 (c) | PA-1 | 0.070 | PA-1/P-1 | 0.035/ 0.039 | P-1 | 0.027 |

TABLE VI-continued

| | Magenta Couplers | | | | | |
|---|---|---|---|---|---|---|
| | FAST GREEN LAYER | | INTERMEDIATE GREEN LAYER | | SLOW GREEN LAYER | |
| EXAMPLE | COUPLER | LAYDOWN | COUPLER | LAYDOWN | COUPLER | LAYDOWN |
| 11 | PA-2 | 0.075 | PA-2/P-1 | 0.037/ 0.039 | P-1 | 0.027 |

TABLE VII

| | Photographic Data | | | | |
|---|---|---|---|---|---|
| EXAMPLE | RELATIVE MAGENTA COUPLER FM/MM/SM | RELATIVE GREEN SPEED Gn | GAMMA (G) | SENSITIVITY TO PROCESS pH | RELATIVE GREEN GRANULARITY '−1' (GU) |
| 7 (e) | PA-1/P-1/P-1 | 1 | 0.73 | 0.43 | 0 |
| 8 | PA-2/P-1/P-1 | 1.00 | 0.70 | 0.36 | −1 |
| 9 | PA-5/P-1/P-1 | 1.03 | 0.68 | 0.18 | −1.4 |
| 10 (c) | PA-1/PA-1 + P-1/ P-1 | 1.01 | 0.65 | 0.42 | +1.3 |
| 11 | PA-2/PA-2 + P-1/ P-1 | 1.01 | 0.73 | 0.41 | −1 |

Note that in Table 7, the activity of P-1 relative to PA-1 is more than 85% as determined by the CZA method, whereas the activity of P-1 relative to PA-2 or PA-5 is less than 85%. Only the inventive combination of the more active pyrazolotriazole coupler in the more sensitive layer with the pyrazolone coupler in the least sensitive layer gives the desired results of low granularity and low process sensitivity.

It is to be understood that the foregoing detailed description and specific examples, while indicating preferred embodiments of the present invention, are given by way of illustration and not limitation. Many changes and modifications within the scope of the present invention may be made without departing from the spirit thereof, and the invention includes all such modifications.

What is claimed is:

1. A photographic element comprising a support and first and second green-sensitive silver halide emulsion layers of different sensitivity, wherein said first layer has a higher sensitivity than said second layer and comprises a two-equivalent magenta dye-forming coupler selected from the group consisting of a pyrazolone coupler having a structure according to formula I

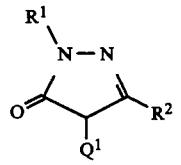

(I)

wherein $R^1$ is an unsubstituted aryl group, or an aryl or pyridyl group substituted with one or more substituents selected from the group consisting of halogen atoms and alkyl, alkoxy, aryloxy, acyloxy, alkoxycarbonyl, aryloxycarbonyl, alkylsulfonyl, arylsulfonyl, sulfamoyl, sulfonamido, carbamoyl, carbonamido, ureido, nitro, cyano and trifluoromethyl;

$R^2$ is an anilino, acylamino or ureido group which is unsubstituted or substituted with one or more substituents selected from the group consisting of halogen atoms and alkyl, aryl, alkoxy, aryloxy, acyl, acyloxy, alkoxycarbonyl, aryloxycarbonyl, alkylthio, alkylsulfoxyl, arylsulfoxyl, alkylsulfonyl, arylsulfonyl, sulfamoyl, sulfonamido, carbamoyl, carbonamido, carbamate, carboxyl, ureido, nitro, imido, cyano, trifluoromethyl, hydroxyl and heterocyclyl groups and groups which form a link to a polymeric chain, and wherein $R^2$ contains at least 6 carbon atoms, and $Q^1$ is a coupling-off group selected from the group consisting of halogen atoms and alkoxy, aryloxy, alkylthio, arylthio, acyloxy, sulfonamido, sulfonyloxy, carbonamido, arylazo, imido and nitrogen-containing heterocyclic groups, and a pyrazoloazole coupler having a structure according to formula II

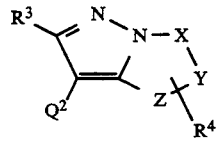

(II)

wherein $R^3$ is a substituent in the 6-position which does not adversely affect the desired properties of the coupler, $Q^2$ is a coupling-off group, X, Y, Z are individually carbon or nitrogen atoms necessary to complete an azole ring, with unsaturated bonding being present in the ring as needed, $R^4$ denotes the group

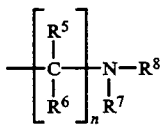

$R^5$, $R^6$ are individually hydrogen or unsubstituted or substituted alkyl or aryl, with the proviso that both are not hydrogen, n is 1 or 2, $R^7$, $R^8$ are individually hydrogen, unsubstituted or substituted alkyl or aryl, —C(O)—$R^9$ or —$SO_2R^9$, at most one of $R^7$ and $R^8$ being hydrogen, $R^9$ is unsubstituted or substituted alkyl or aryl or —NH—$R^{10}$, and $R^{10}$is unsubstituted or substituted alkyl or aryl, and wherein said second layer has lower sensitivity than said first layer and comprises a two-equivalent magenta dye-forming coupler selected from the group consisting of couplers defined by formulas I and II, wherein the activity of said dye-forming coupler present in said second layer of lower sensitivity is less than the activity of said dye-forming coupler present in said first layer of higher sensitivity, with the proviso that said first layer comprises a coupler of formula I and said second layer comprises a coupler of formula II or said first layer comprises a coupler of formula II and said second layer comprises a coupler of formula I.

2. A photographic element as claimed in claim 1, wherein the activity of said dye-forming coupler present in said layer of lower sensitivity is less than about 85% of the activity of said dye-forming coupler present in said layer of higher sensitivity.

3. A photographic element as claimed in claim 1, wherein $R^1$ is a group having the structure

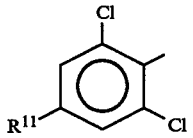

wherein $R^{11}$ is selected from the group consisting of halogen atoms and aryloxy, acyloxy, alkoxycarbonyl, aryloxycarbonyl, alkylsulfonyl, arylsulfonyl, sulfamoyl, sulfonamido, carbamoyl, carbonamido, ureido, nitro, cyano and trifluoromethyl groups.

4. A photographic element as claimed in claim 1, wherein said dye-forming coupler present in said layer of higher sensitivity is a pyrazolone coupler having a structure according to formula I and said dye-forming coupler present in said layer of lower sensitivity is a pyrazoloazole coupler having a structure according to formula II.

5. A photographic element as claimed in claim 4, wherein $R^2$ comprises between 6 and 30 carbon atoms.

6. A photographic element as claimed in claim 5, wherein $R^2$ is an anilino group.

7. A photographic element as claimed in claim 6, wherein $R^2$ is a group having the structure

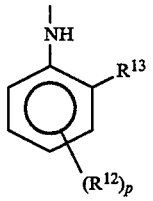

wherein

P is 0, 1 or 2, and each $R^{12}$ is meta or para to $R^{13}$, $R^{12}$is individually a halogen atom or an alkyl, alkoxy, aryloxy, acyl, acyloxy, aryloxycarbonyl, alkylthio, alkylsulfoxyl, arylsulfoxyl, sulfonamido, sulfamoyl, carbonamido, carbamoyl, carbamate, carboxyl, ureido, nitro, imido, cyano, trifluoromethyl or heterocyclyl group, and $R^{13}$ is selected from the group consisting of hydrogen, a halogen atom, and an alkyl, alkoxy, aryloxy, acyl, acyloxy, alkoxycarbonyl, alkylthio, alkylsulfonyl, sulfonamido, sulfamoyl, carbonamido, carbamoyl, nitro, cyano or trifluoromethyl group.

8. A photographic element as claimed in claim 7, wherein $R^{13}$ is a chlorine atom or an alkoxy group.

9. A photographic element as claimed in claim 4, wherein $Q^1$ is a group having the structure

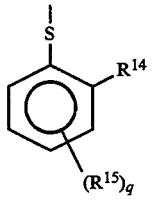

wherein $R^{14}$, $R^{15}$ are individually hydrogen, halogen, or an alkyl, alkoxy, aryloxy, acyloxy, alkoxycarbonyl, aryloxycarbonyl, sulfonamido, sulfamoyl, carbonamido, carbamoyl, carbamate, carboxyl, ureido or amino group, and q is 0, 1 or 2.

10. A photographic element as claimed in claim 9, wherein $R^{15}$ is meta or para to the sulfur atom.

11. A photographic element as claimed in claim 9, wherein $R^{14}$ has at least one carbon atom and the total number of carbon atoms in $R^{14}$ and $R^{15}$ is between about 5 and 25.

12. A photographic element as claimed in claim 4, wherein $R^3$ is an unsubstituted or substituted alkyl, aryl, alkoxy or carbonamido group.

13. A photographic element as claimed in claim 4, wherein said pyrazolone coupler is selected from the group consisting of:

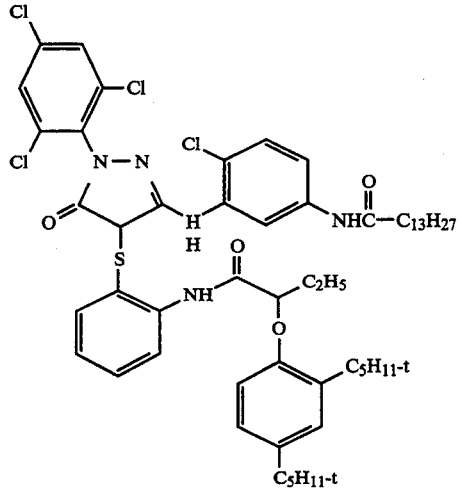
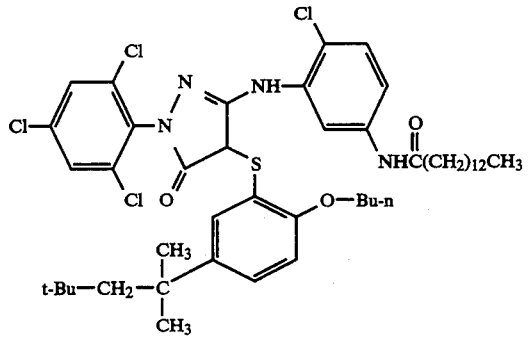
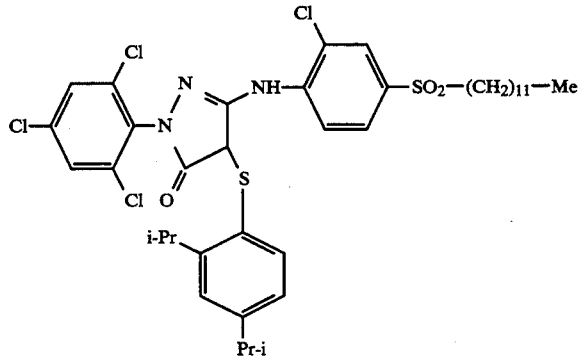
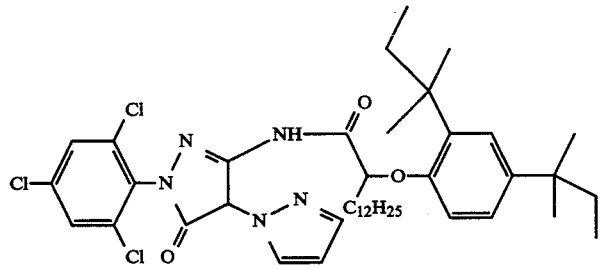

-continued

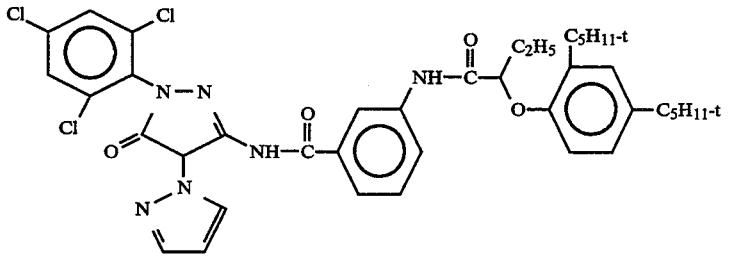

14. A photographic element as claimed in claim 1, wherein $R^3$ is an unsubstituted or substituted alkyl, aryl, alkoxy or carbonamido group.

15. A photographic element as claimed in claim 4, wherein $R^3$ is an unsubstituted or substituted alkyl or aryl group.

16. A photographic element as claimed in claim 4, wherein X, Y and Z are individually carbon or nitrogen atoms necessary to complete a triazole ring.

17. A photographic element as claimed in claim 16, wherein said pyrazoloazole coupler is a pyrazolotriazole having a structure according to formula III

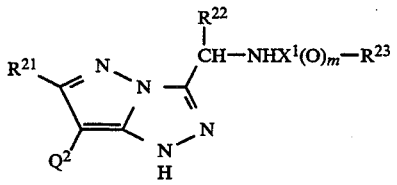

(III)

or formula IV

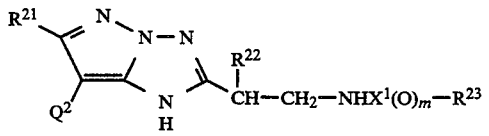

(IV)

wherein $R^{21}$ is a substituent which does not adversely affect the desired properties of the pyrazolotriazole coupler, $R^{22}$ is unsubstituted or substituted alkyl or aryl, $R^{23}$ is unsubstituted or substituted alkyl, aryl, or —NH—$R^{24}$, $R^{24}$ is unsubstituted or substituted alkyl or aryl, $X^1$ is a carbon or sulfur, and m is 1 or 2.

18. A photographic element as claimed in claim 17, wherein $R^{21}$ is an unsubstituted or substituted alkyl or aryl group.

19. A photographic element as claimed in claim 18, wherein said pyrazolotriazole coupler is selected from the group consisting of:

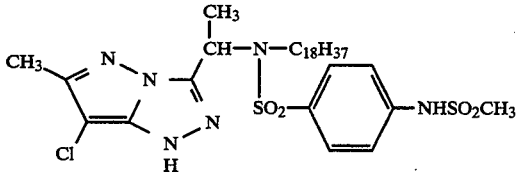

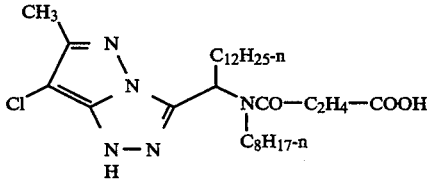

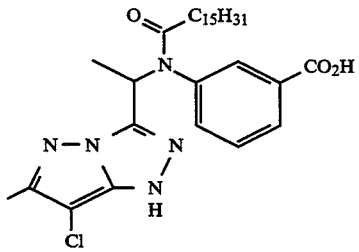

-continued

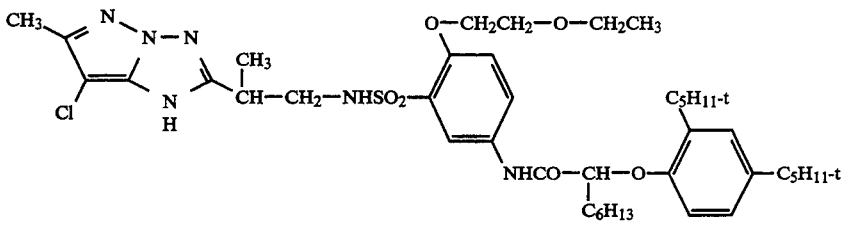

20. A photographic element as claimed in claim 15, wherein $R^3$ is a tertiary carbon group having the structure

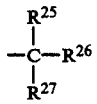

wherein $R^{25}$, $R^{26}$ and $R^{27}$ are individually substituents that do not adversely affect said coupler 21. A photographic element as claimed in claim 20, wherein $R^{25}$, $R^{26}$ and $R^{27}$ are individually halogen atoms or unsubstituted or substituted alkyl, aryl, carbonamido, ureido, carboxy, cyano, sulfamyl, sulfonamido, carboxamido, cycloalkyl, alkoxy, alkylthio, aryloxy, arylthio, amino, acylamino or heterocyclyl groups.

22. A photographic element as claimed in claim 20, wherein $R^{25}$ form with one of $R^{26}$ and $R^{27}$ a heterocyclic ring.

23. A photographic element as claimed in claim 20, wherein $R^{25}$ forms with at least one of $R^{26}$ and $R^{27}$ a carbocyclic ring.

24. A photographic element according to claim 1, wherein said dye-forming coupler present in said layer of higher sensitivity is a pyrazoloazole coupler having a structure according to formula II and said dye-forming coupler present in said layer of lower sensitivity is a pyrazolone coupler having a structure according to formula I.

25. A photographic element according to claim 24, wherein $R^2$ is an anilino group.

26. A photographic element according to claim 24, wherein X, Y and Z are individually carbon or nitrogen atoms necessary to complete a triazole ring.

27. A photographic element according to claim 1, wherein X, Y and Z are individually carbon or nitrogen atoms necessary to complete a triazole ring.

28. A photographic element according to claim 1 comprising a third silver halide emulsion layer sensitized to green light having a sensitivity intermediate between said first and second layers, wherein said third layer comprises the same magenta dye-forming coupler as said second layer.

29. A process for developing an image in a photographic element as claimed in claim 1, comprising the step of developing said element with a silver halide color developing agent.

30. A photographic element as claimed in claim 1, wherein said first and said second layers are adjacent.

31. A photographic element as claimed in claim 30, wherein adjacent to said second layer is a third silver halide emulsion layer sensitized to green light having a sensitivity less than that of said first and said second layers, wherein said third layer comprises the same magenta dye-forming coupler as said second layer 32. A multicolor photographic element comprising a support bearing (a) a cyan dye image-forming unit comprising at least one red-sensitive silver halide emulsion layer having associated therewith at least one cyan dye-forming coupler, (b) a magenta dye image-forming unit comprising at least first and second green-sensitive silver halide emulsion layers of different sensitivity each having associated therewith at least one two-equivalent magenta dye-forming coupler, and (c) a yellow dye image-forming unit comprising at least one blue-sensitive silver halide emulsion layer having associated therewith at least one yellow dye-forming coupler, said two-equivalent magenta dye-forming coupler associated with said green-sensitive emulsion layer having the higher sensitivity being selected from the group consisting of a pyrazolone coupler having a structure according to formula I

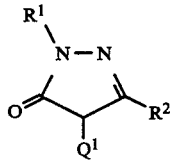

(I)

wherein $R^1$ is an unsubstituted aryl group, or an aryl or pyridyl group substituted with one or more substituents selected from the group consisting of halogen atoms and alkyl, alkoxy, aryloxy, acyloxy, alkoxycarbonyl, aryloxycarbonyl, alkylsulfonyl, arylsulfonyl, sulfamoyl, sulfonamido, carbamoyl, carbonamido, ureido, nitro, cyano and trifluoromethyl;

$R^2$ is an anilino, acylamino or ureido group which is unsubstituted or substituted with one or more substituents selected from the group consisting of halogen atoms and alkyl, aryl, alkoxy, aryloxy, acyl, acyloxy, alkoxycarbonyl, aryloxycarbonyl, alkylthio, alkylsulfoxyl, arylsulfoxyl, alkylsulfonyl, arylsulfonyl, sulfamoyl, sulfonamido, carbamoyl, carbonamido, carbamate, carboxyl, ureido, nitro, imido, cyano, trifluoromethyl, hydroxyl and heterocyclyl groups and groups which form a link to a polymeric chain, and wherein $R^2$ contains at least 6 carbon atoms, and $Q^1$ is a coupling-off group selected from the group consisting of halogen atoms and alkoxy, aryloxy, alkylthio, arylthio, acyloxy, sulfonamido, sulfonyloxy, carbonamido, arylazo, imido and nitrogen-containing heterocyclyl groups, and a pyrazoloazole coupler having a structure according to formula II

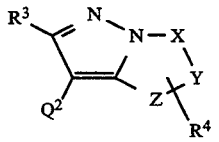

(II)

wherein $R^3$ is a substituent in the 6-position which does not adversely affect the desired properties of the coupler, $Q^2$ is a coupling-off group, X, Y, Z are individually carbon or nitrogen atoms necessary to complete an azole ring, with unsaturated bonding being present in the ring as needed, $R^4$ denotes the group

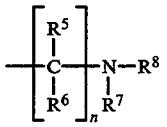

$R^5$ $R^6$ are individually hydrogen or unsubstituted or substituted alkyl or aryl, with the proviso that both are not hydrogen, n is 1 or 2, $R^7$, $R^8$ are individually hydrogen, unsubstituted or substituted alkyl or aryl, —C(O)—$R^9$ or —$SO_2R^9$, at most one of $R^7$ and $R^8$ being hydrogen, $R^9$ is unsubstituted or substituted alkyl or aryl or —NH—$R^{10}$, and $R^{10}$ is unsubstituted or substituted alkyl or aryl, and said two-equivalent magenta dye-forming coupler associated with said layer having the lower sensitivity being selected from the group consisting of couplers defined by formulas I and II, wherein the activity of said dye-forming coupler present in said layer of lower sensitivity is less than the activity of said dye-forming coupler present in said layer of higher sensitivity, with the proviso that said first green-sensitive layer comprises a coupler of formula I and said Second green-sensitive layer comprises a coupler of formula II or said first green-sensitive layer comprises a coupler of formula II and said second green-sensitive layer Comprises a coupler of formula I.

33. A photographic element according to claim 32, wherein said dye-forming coupler present in said layer of lower sensitivity is a pyrazoloazole coupler having a structure according to formula II and said dye-forming coupler present in said layer of higher sensitivity is a pyrazolone coupler having a structure according to formula I.

34. A photographic element according to claim 33, wherein $R^2$ is an anilino group.

* * * * *